US011624514B2

(12) United States Patent
Xing et al.

(10) Patent No.: US 11,624,514 B2
(45) Date of Patent: Apr. 11, 2023

(54) WINDOW AIR CONDITIONER WITH WATER RECEIVING PAN AND FILTER SCREEN SUPPORT

(71) Applicants: GD MIDEA AIR-CONDITIONING EQUIPMENT CO., LTD., Foshan (CN); MIDEA GROUP CO., LTD., Foshan (CN)

(72) Inventors: Zhigang Xing, Foshan (CN); Hui Yu, Foshan (CN); Zhisheng Lei, Foshan (CN); Kangwen Zhang, Foshan (CN); Yu Liu, Foshan (CN); Yuhang Tang, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 749 days.

(21) Appl. No.: 16/498,028

(22) PCT Filed: Mar. 28, 2019

(86) PCT No.: PCT/CN2019/080050
§ 371 (c)(1),
(2) Date: Sep. 26, 2019

(87) PCT Pub. No.: WO2020/155352
PCT Pub. Date: Aug. 6, 2020

(65) Prior Publication Data

US 2021/0332988 A1 Oct. 28, 2021

(30) Foreign Application Priority Data

Feb. 3, 2019 (CN) ..... 201920188057.7
Feb. 3, 2019 (CN) ..... 201920188070.2

(51) Int. Cl.
*F24F 1/027* (2019.01)
*F24F 8/10* (2021.01)
(Continued)

(52) U.S. Cl.
CPC ..... *F24F 1/027* (2013.01); *F24F 1/0063* (2019.02); *F24F 1/035* (2019.02); *F24F 1/0323* (2019.02);
(Continued)

(58) Field of Classification Search
CPC ..... F24F 1/027; F24F 1/031; F24F 13/224; F24F 13/32; F24F 1/0323; F24F 13/30; F24F 8/10; F24F 1/035; F24F 1/0063
(Continued)

(56) References Cited

U.S. PATENT DOCUMENTS 2,604,763 A * 7/1952 Lipman ..... F24F 1/027 62/262
3,372,557 A * 3/1968 Dyas ..... F24F 13/20 62/262
(Continued)

FOREIGN PATENT DOCUMENTS

CN 1064123 C * 4/2001 ..... F24F 1/0007
CN 201262445 Y 6/2009
(Continued)

OTHER PUBLICATIONS

Huang Y et al, Window Type Air Conditioner, Oct. 2018, CN-208025643-U, (Year: 2018).*
(Continued)

*Primary Examiner* — Edelmira Bosques
*Assistant Examiner* — Frances F. Hamilton
(74) *Attorney, Agent, or Firm* — Anova Law Group PLLC

(57) ABSTRACT

A window air conditioner includes an indoor heat exchanger, a water receiving pan below the heat exchanger, and a filter
(Continued)

screen. The water receiving pan includes mounting portions for connecting to heat exchanger flanges. At least one mounting portion has a slot to cooperatively receive a filter screen fitting portion.

18 Claims, 17 Drawing Sheets

(51) Int. Cl.
*F24F 1/0323* (2019.01)
*F24F 13/22* (2006.01)
*F24F 1/0063* (2019.01)
*F24F 1/035* (2019.01)
*F24F 13/32* (2006.01)

(52) U.S. Cl.
CPC ..... *F24F 8/10* (2021.01); *F24F 13/224* (2013.01); *F24F 13/32* (2013.01)

(58) Field of Classification Search
USPC ..... 62/285; 454/201, 203
See application file for complete search history.

(56) References Cited

U.S. PATENT DOCUMENTS 5,211,219 A * 5/1993 Kawabata ..... F28D 1/0477 165/122
5,295,903 A * 3/1994 Bolton ..... F24F 1/027 454/203
5,392,613 A * 2/1995 Bolton ..... F24F 1/027 62/262
5,396,778 A 3/1995 Bolton et al.
5,437,164 A * 8/1995 Consiglio ..... F24F 1/027 138/40
5,575,326 A * 11/1996 Asami ..... F24F 1/0323 165/122
6,389,834 B1 * 5/2002 LeClear ..... F24F 13/222 62/262
7,121,105 B1 * 10/2006 Rais ..... F24F 1/027 62/262
9,671,128 B2 * 6/2017 Andrew ..... B01D 46/121
2015/0153064 A1 * 6/2015 Mercer ..... F24F 13/22 62/291
2017/0003038 A1 * 1/2017 Uda ..... F24F 13/28
2018/0023820 A1 * 1/2018 Kim ..... F24F 1/0057 250/435
2018/0094874 A1 * 4/2018 Sakamaki ..... F28F 9/22

FOREIGN PATENT DOCUMENTS

CN 103299135 B * 11/2015 ..... F24F 1/027
CN 105546666 A * 5/2016
CN 108443978 A * 8/2018 ..... F24F 1/027
CN 108443978 A 8/2018
CN 108458405 A * 8/2018
CN 207920969 U 9/2018
CN 108679718 A * 10/2018
CN 208025643 U 10/2018
CN 208025643 U * 10/2018
CN 208025684 U 10/2018
CN 208025811 U * 10/2018
CN 208025812 U * 10/2018
CN 109724168 A * 5/2019
CN 109724172 A * 5/2019
CN 209944569 U * 1/2020
EP 1988342 A1 * 11/2008 ..... B01D 46/002
JP H1030827 A * 7/1996
JP 0947781 A1 * 9/1998
JP 2008261541 A * 10/2008
KR 20050091169 A * 11/2004
KR 20050048870 A 5/2005
KR 20070070086 A * 12/2006
TW 524957 B * 3/2002

OTHER PUBLICATIONS

Huang Y et al, Window Type Airconditioner, Oct. 2018, CN-208025811-U (Year: 2018).*
Tetsuya et al, Air Conditioner, Feb. 1998, JP-H1030827-A (Year: 1998).*
Huang Y et al, Window Type Airconditioner, Oct. 2018, CN-208025684-U (Year: 2018).*
You et al, Air Conditioning Device, May 2020, CN108443978-B (Year: 2020).*
Chen et al, The Air Conditioner Indoor Machine and Air Conditioner, Aug. 2018, CN108456405-A (Year: 2018).*
World Intellectual Property Organization (WIPO) International Search Report for PCT/CN2019/080050 dated Nov. 6, 2019 10 Pages.
World Intellectual Property Organization (WIPO) International Search Report for PCT/CN2019/080050 dated Nov. 6, 2019 20 Pages.

* cited by examiner

WINDOW AIR CONDITIONER WITH WATER RECEIVING PAN AND FILTER SCREEN SUPPORT

CROSS-REFERENCE TO RELATED APPLICATIONS

This application is a National Stage Entry under 35 U.S.C. § 371 of International Application No. PCT/CN2019/080050, filed on Mar. 28, 2019, which is based on and claims priority to Chinese Patent Application Serial No. 201920188070.2 and No. 201920188057.7, filed on Feb. 3, 2019, the entire contents of all of which are incorporated herein by reference.

FIELD

The present disclosure relates to a field of refrigeration, and particularly, to a window air conditioner.

BACKGROUND

An existing window air conditioner is mounted to a window of a room with the window being located above the window air conditioner. During the operation of the window air conditioner, noise generated by an outdoor compressor will be transmitted into the room, degrading the use comfort. In order to meet refrigeration requirements, the existing window air conditioner is designed with a large size, which occupies a large space and lowers a space utilization rate.

SUMMARY

The present disclosure aims to solve one of the technical problems existing in the related art to at least some extent. To this end, the present disclosure provides a window air conditioner, in which a space occupied when an indoor heat exchanger cooperates with an indoor fan wheel can be reduced, and hence the window air conditioner has a reduced volume and occupies a smaller space.

According to an embodiment of the present disclosure, the window air conditioner is supported in a window opening of a wall, and a movable window is provided in the window opening. The window air conditioner includes a casing having a receiving groove formed at an outer peripheral wall of the casing, and divided into an indoor portion and an outdoor portion by the receiving groove, at least a part of the window being able to extend into the receiving groove, and the indoor portion including an air inlet and an air outlet; an indoor fan wheel arranged in the indoor portion; an indoor heat exchanger arranged in the indoor portion and including a first heat exchange portion and a second heat exchange portion, the first heat exchange portion extending vertically, and the second heat exchange portion having an upper end connected to a lower end of the first heat exchange portion and a lower end obliquely extending towards the indoor fan wheel; and a filter screen located upstream of the indoor heat exchanger in an air-flowing direction.

For the window air conditioner according to the embodiment of the present disclosure, the casing is provided with the receiving groove, and at least a part of the window can extend into the receiving groove, such that the window can position the window air conditioner to some extent for fixation, and the window air conditioner can be prevented from falling off. The window extending into the receiving groove can provide a sound insulation effect, a heat insulation effect, and a sealing effect to some extent, thereby improving the use comfort. A user can choose whether to provide a sealing assembly to seal a space between the window and the window opening according to actual needs. Even if the sealing assembly is provided, the sealing assembly of the window air conditioner according to the embodiment of the present disclosure needs fewer materials compared with a sealing assembly in the related art, thereby saving the cost.

In the meantime, since the indoor heat exchanger includes the first heat exchange portion extending vertically and the second heat exchange portion extending obliquely, not only a heat exchange area of the indoor heat exchanger can be enlarged and a heat exchange effect of the indoor heat exchanger can be improved, but also a space occupied by the indoor heat exchanger and the indoor fan wheel when they cooperate with each other can be reduced, thereby reducing a size of the window air conditioner and a space occupied by the window air conditioner.

In some embodiments of the present disclosure, an angle A between the second heat exchange portion and a horizontal plane is in a range between 35° and 55°.

In some embodiments of the present disclosure, the first heat exchange portion vertically extends by a length H1, the second heat exchange portion obliquely extends by a length H2, and a ratio of H1/H2 is in a range between 0.2 and 0.4.

In some embodiments of the present disclosure, the filter screen and the indoor heat exchanger are spaced apart, the filter screen includes a first filtering portion and a second filtering portion, the first filtering portion extends vertically, and the second filtering portion has an upper end connected to a lower end of the first filtering portion and a lower end obliquely extending towards the indoor fan wheel.

In some embodiments of the present disclosure, a distance between the first filtering portion and the first heat exchange portion is d1, a distance between the second filtering portion and the second heat exchange portion is d2, and a ratio of d1/d2 ranges from 0.9 to 1.2.

In some embodiments of the present disclosure, the indoor portion includes the air outlet in a top thereof, a plane where the air outlet is located is configured as an air outlet plane, and the air outlet plane obliquely extends rearwards in a direction from bottom to top.

In some embodiments of the present disclosure, an angle B between the air outlet plane and a vertical plane is in a range between 50° and 66°.

In some embodiments of the present disclosure, the second heat exchange portion has more rows of heat exchange tubes than the first heat exchange portion.

In some embodiments of the present disclosure, the casing includes: a chassis; a rear case fixed on the chassis and configured to receive an outer heat exchanger; and a front case fixed on the chassis and spaced apart from the rear case in a front-rear direction to define the receiving groove.

In some embodiments of the present disclosure, the indoor heat exchanger has a side plate assembly; the window air conditioner further includes a water receiving pan, the water receiving pan is provided with a rib assembly configured to support the side plate assembly, and the water receiving pan is provided below a heat exchanger assembly.

In some embodiments of the present disclosure, the rib assembly includes a first rib and a second rib spaced apart from each other, the side plate assembly includes a first side plate and a second side plate, the first side plate is arranged at a first end of the heat exchanger assembly, and the heat exchanger assembly has a heat exchange tube running through the first side plate, the first rib is used to support the first side plate, and the second rib is used to support the second side plate.

In some embodiments of the present disclosure, the first side plate has a first flange, the first flange abuts against the first rib and is connected to the first rib by means of a screw, the second side plate has a second flange, and the second flange abuts against the second rib and is connected to the second rib by means of a screw.

In some embodiments of the present disclosure, the first flange extends towards the second side plate, and the second flange extends towards the first side plate.

In some embodiments of the present disclosure, the first flange and the second flange are each provided with a lug, and the lug has a screw hole.

In some embodiments of the present disclosure, the first rib and the second rib each have an oblique support surface to support a surface of a part of the second heat exchange portion facing the water receiving pan.

In some embodiments of the present disclosure, the first rib and the second rib each have a water hole.

In some embodiments of the present disclosure, the water receiving pan is provided with an auxiliary water receiving portion to receive condensation water from a refrigerant tube, and the auxiliary water receiving portion is in communication with the water hole.

In some embodiments of the present disclosure, the first rib is provided with the water hole, and a drain channel is located at a side of the first rib away from the second rib.

In some embodiments of the present disclosure, the water receiving pan is provided with a first fitting portion, and the filter screen has a second fitting portion cooperating with the first fitting portion.

In some embodiments of the present disclosure, one of the first fitting portion and the second fitting portion includes a slot, and the other one thereof is received in the slot.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

These and/or other aspects and advantages of embodiments of the present disclosure will become apparent and more readily appreciated from the following descriptions made with reference the accompanying drawings, in which.

Figure 1:
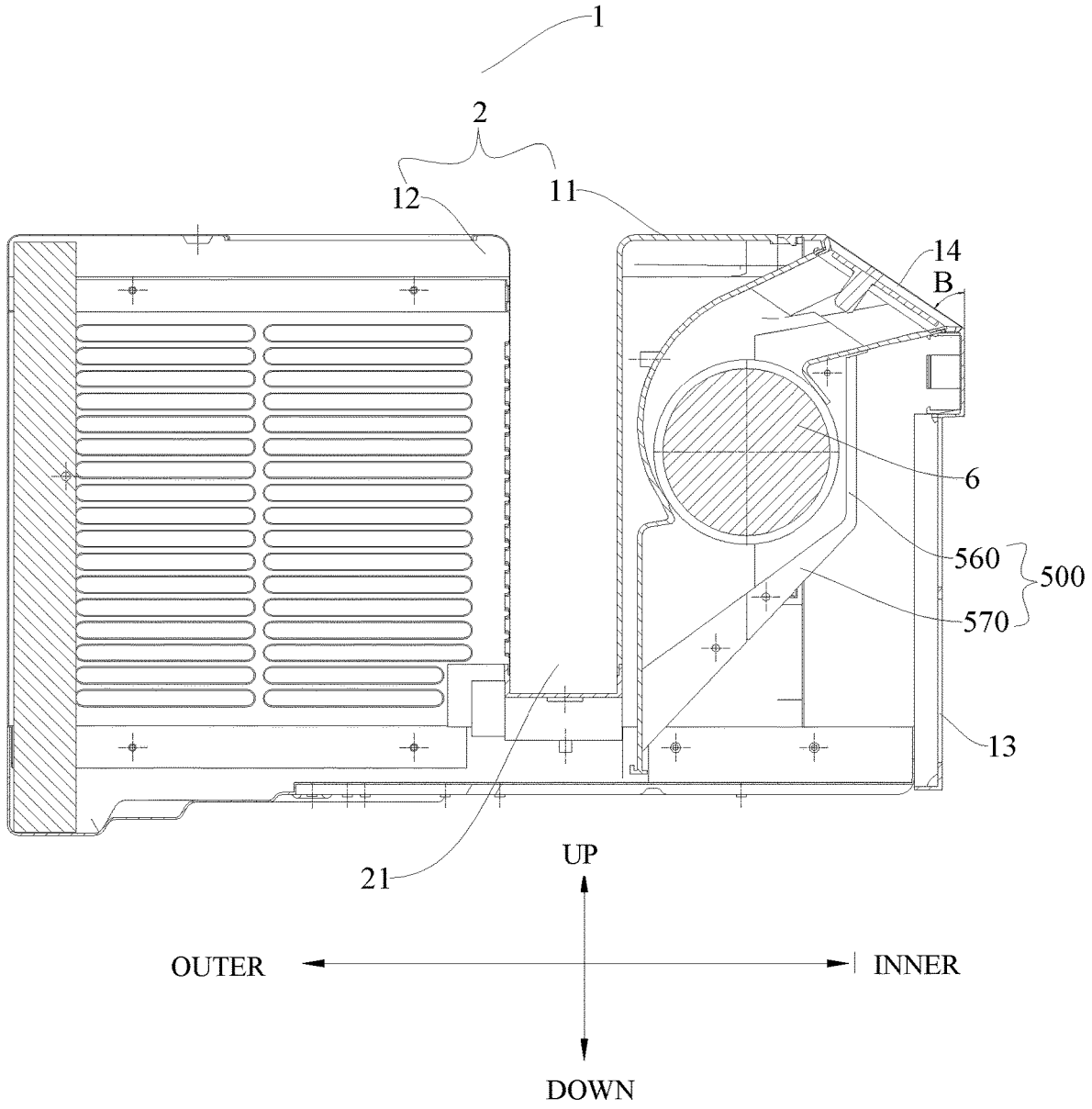
FIG. 1 is a sectional view of a window air conditioner according to an embodiment of the present disclosure.

REFERENCE NUMERALS window air conditioner 1, window opening 5, window 3, wall 4, chassis 100, indoor fan wheel 6, soundproof member 200, first end 201, second end 202, first channel 210, second channel 220, intermediate partition plate 300, first extension 310, second extension 320, water receiving pan 400, communication member 410, drain channel 411, tapered segment 412, first mounting portion 420, first rib 421, second mounting portion 430, second rib 431, first fitting portion 440, auxiliary water receiving portion 450, indoor heat exchanger 500, third mounting portion 510, fourth mounting portion 520, heat exchange tube 530, first side plate 540, first flange 541, lug 5400, screw hole 5401, water hole 5402, second side plate 550, first heat exchange portion 560, second heat exchange portion 570, filter screen 600, first filtering portion 610, second filtering portion 612, second fitting portion 640, casing 2, receiving groove 21, rear case 23, rear case seat 24, rear case cover 25, front case 26, indoor portion 11, outdoor portion 12, air inlet 13, air outlet 14, intermediate partition board 18.

DETAILED DESCRIPTION

Embodiments of the present disclosure will be described in detail and examples of the embodiments will be illustrated in the accompanying drawings, where same or similar reference numerals are used to indicate same or similar members or members with same or similar functions. The embodiments described herein with reference to the drawings are explanatory, which aim to illustrate the present disclosure, but shall not be construed to limit the present disclosure.

In the specification, it is to be understood that terms such as "central," "longitudinal," "lateral," "length," "width," "thickness," "upper," "lower," "front," "rear," "left," "right," "vertical," "horizontal," "top," "bottom," "inner," "outer," "axial," "radial," and "circumferential" should be construed to refer to the orientation as then described or as shown in the drawings under discussion. These relative terms are for convenience of description and do not indicate or imply that the corresponding device or component has to oriented in a particular direction, or is constructed or operated in a particular orientation, and hence shall not be construed to limit the present disclosure. Furthermore, the feature defined with "first" and "second" may explicitly or impliedly comprise one or more of such feature. In the description of the present disclosure, the term "plurality of" means two or more than two, unless specified otherwise.

In the description of the present disclosure, it should be understood that, unless specified or limited otherwise, the terms "mounted," "connected," and "coupled" and variations thereof are used broadly and encompass such as mechanical or electrical mountings, connections and couplings, also can be inner mountings, connections and couplings of two components, and further can be direct and indirect mountings, connections, and couplings, which can be understood by those skilled in the art according to the detail embodiment of the present disclosure.

A window air conditioner 1 according to embodiments of the present disclosure will be described with reference to the drawings. The window air conditioner 1 is supported at a window opening 5 in a wall 4, and the window opening 5 is provided with a movable window 3.

Figure 2:
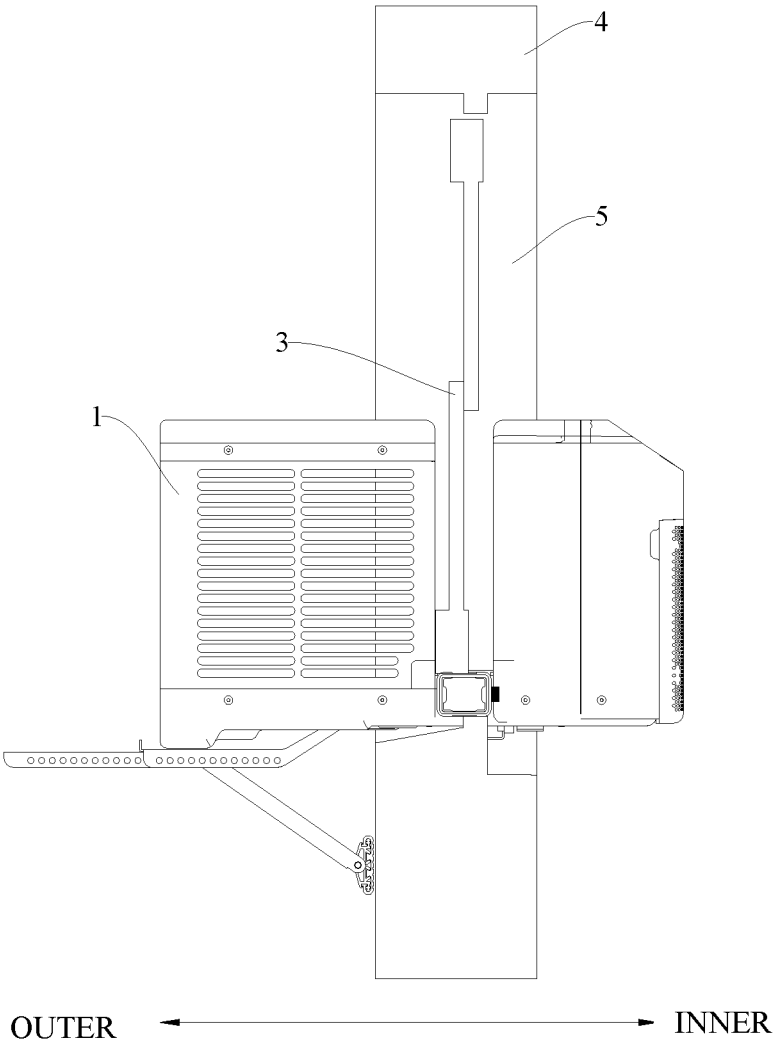
FIG. 2 is a schematic view of a window air conditioner mounted in a window opening according to an embodiment of the present disclosure.

As shown in FIG. 1, the window air conditioner 1 according to an embodiment of the present disclosure includes a casing 2, an indoor fan wheel 6, an indoor heat exchanger 500 and a filter screen 600. The casing 2 has an outer peripheral wall provided with a receiving groove 21, and the casing 2 is divided into an indoor portion 11 and an outdoor portion 12 by the receiving groove 21. As shown in FIG. 2, at least a part of the window 3 can extend into the receiving groove 21. Specifically, the receiving groove 21 has an open top, an open left side, and an open right side, such that the window 3 can be pulled down into the receiving groove 21. In a specific example of the present disclosure, a distance between the indoor portion 11 and the outdoor portion 12 is unadjustable. For instance, the casing 2 has an integrally formed chassis.

The indoor portion 11 is provided with an air inlet 13 and an air outlet 14. The indoor fan wheel 6 is arranged in the indoor portion 11. Specifically, during rotation of the indoor fan wheel, indoor air enters the indoor portion 11 through the air inlet 13 and is output to an indoor space from the air outlet 14 after heat exchange. Optionally, the indoor fan wheel 6 may be a cross-flow fan wheel, such that air can be comparatively uniformly blown out from the air outlet 14 over a long distance.

The indoor heat exchanger 500 is arranged in the indoor portion 11. The indoor heat exchanger 500 includes a first heat exchange portion 560 and a second heat exchange portion 570. The first heat exchange portion 560 extends vertically. The second heat exchange portion 570 has an upper end connected to a lower end of the first heat exchange portion 560, and a lower end obliquely extending towards the indoor fan wheel 6. That is, the second heat exchange portion 570 is located below the first heat exchange portion 560, the first heat exchange portion 560 and the second heat exchange portion 570 define an angle therebetween, and the indoor fan wheel 6 is located in an angular area defined by the first heat exchange portion 560 and the second heat exchange portion 570. In a specific example of the present disclosure, the indoor heat exchanger 500 is located at an air introduction side of the indoor fan wheel 6, thereby ensuring a heat exchange effect. It should be understood that, the first heat exchange portion 560 and the second heat exchange portion 570 can be formed by bending one heat exchanger, or the first heat exchange portion 560 and the second heat exchange portion 570 can be two independent heat exchangers.

In an air flowing direction, the filter screen 600 is located upstream of the indoor heat exchanger 500. That is, the air entering the indoor portion 11 is first filtered by the filter screen 600 and then flows to the indoor heat exchanger 500 for heat exchange. Since the filter screen 600 filters the air, dust and the like can be prevented from being directly attached to the indoor heat exchanger 500 and from affecting the heat exchange effect of the indoor heat exchanger 500, while cleanliness of the air output to the indoor space through the air outlet 14 can be improved.

It needs to be noted that, some existing window air conditioners are directly put in the window opening 5, so a lot of sealing assemblies need to be arranged between the window air conditioner and the window opening 5, and between the window 3 and a window sill for sealing, which makes it difficult to mount the window air conditioner and increases the sealing cost. Some existing window air conditioners have a mounting space with an downward opening, and the wall 4 extends into the mounting space to support the window air conditioner, in which case a top board of the window air conditioner bears a relatively large force, and a safety risk exists that the window air conditioner may fall off if the top board breaks.

For the window air conditioner 1 according to the embodiment of the present disclosure, the casing 2 is provided with the receiving groove 21, and at least a part of the window 3 can extend into the receiving groove 21, such that the window 3 can position the window air conditioner 1 to some extent for fixation, and the window air conditioner 1 can be prevented from falling off. The window 3 extending into the receiving groove 21 can provide a sound insulation effect, a heat insulation effect and a sealing effect to some extent, thereby improving the use comfort. A user can choose whether to provide a sealing assembly to seal a space between the window 3 and the window opening 5 according to actual needs. Even if the sealing assembly is provided, the sealing assembly of the window air conditioner 1 according to the embodiment of the present disclosure needs fewer materials compared with a sealing assembly in the related art, thereby saving the cost.

In the meantime, the indoor heat exchanger 500 includes the first heat exchange portion 560 extending vertically and the second heat exchange portion 570 extending obliquely, which not only increases a heat exchange area and improves the heat exchange effect of the indoor heat exchanger 500, but also reduces a space occupied by the indoor heat exchanger 500 and the indoor fan wheel 6 when they cooperate with each other, thereby reducing a volume of the window air conditioner 1 and a space occupied by the window air conditioner 1.

Figure 3:
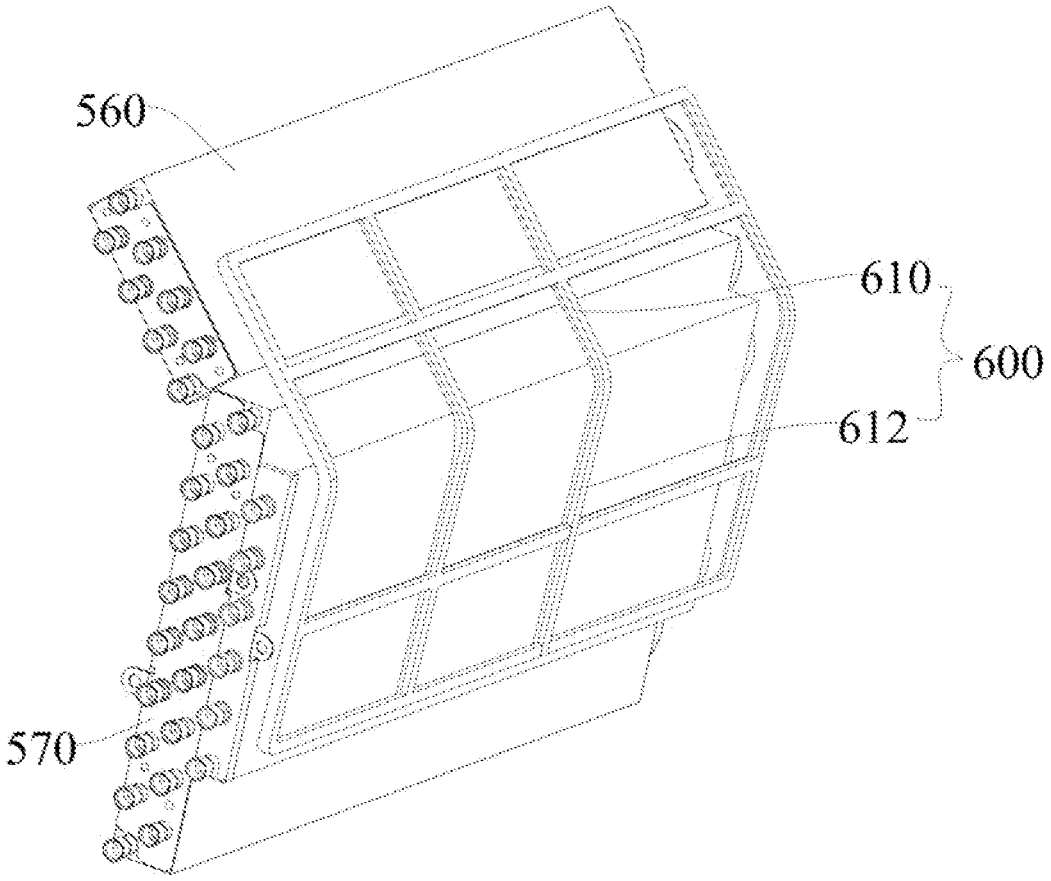
FIG. 3 is a perspective view showing that an evaporator and a filter screen of the present disclosure cooperate with each other.
Figure 4:
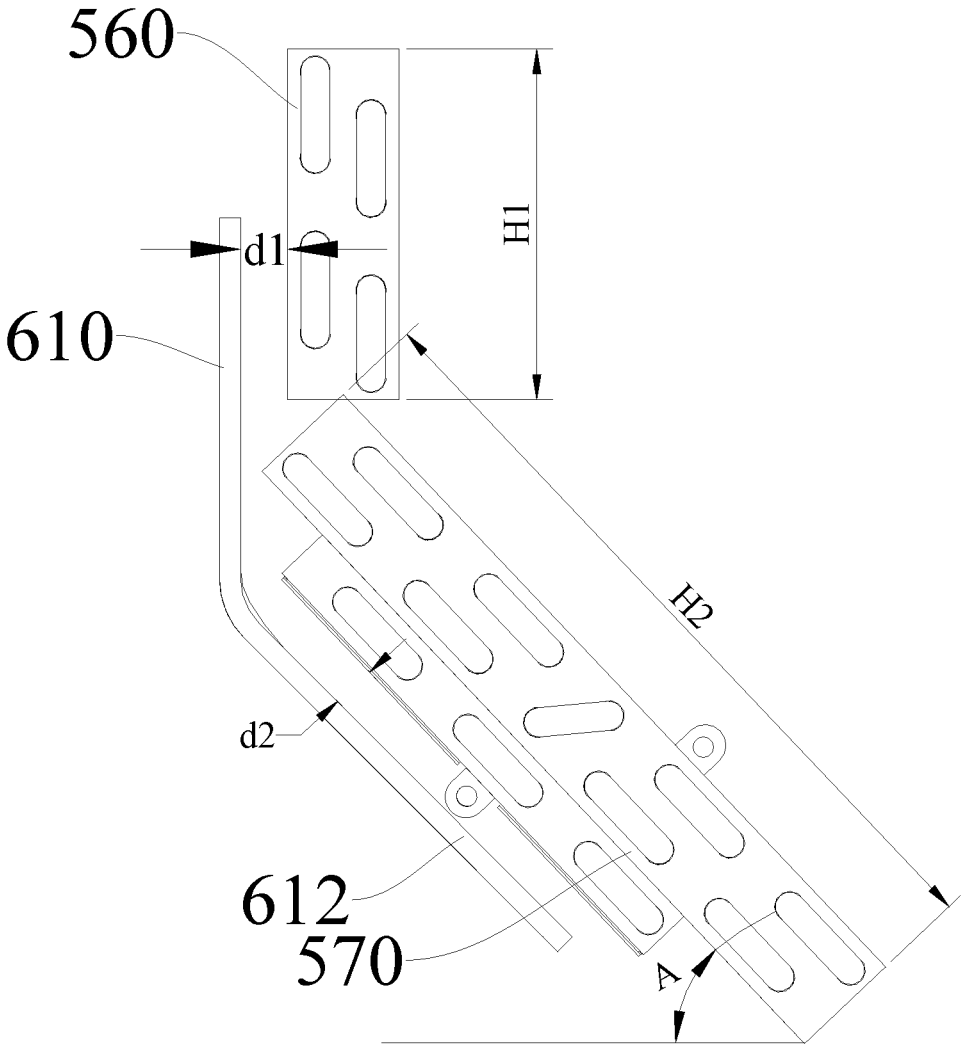
FIG. 4 is a side view showing that an evaporator and a filter screen of the present disclosure cooperate with each other.

In some embodiments of the present disclosure, as shown in FIG. 3 and FIG. 4, an angle A between the second heat exchange portion 570 and a horizontal plane is in a range between 35° and 55°, such that it is possible to avoid influencing the heat exchange effect and occupying more space resulting from an inclination angle of the second heat exchange portion 570 being too large or too small. Preferably, the angle A between the second heat exchange portion 570 and the horizontal plane is 45°.

As shown in FIG. 3 and FIG. 4, in some embodiments of the present disclosure, the first heat exchange portion 560 vertically extends by a length H1, the second heat exchange portion 570 obliquely extends by a length H2, and a ratio of H1/H2 is in a range between 0.2 and 0.4. Thus, a space below the indoor fan wheel 6 can be utilized reasonably. Preferably, a ratio of H1/H2 is 0.3.

In some embodiments of the present disclosure, as shown in FIG. 3 and FIG. 4, the filter screen 600 and the indoor heat exchanger 500 are spaced apart. The filter screen 600 includes a first filtering portion 610 and a second filtering portion 612. The first filtering portion 610 extends vertically. The second filtering portion 612 has an upper end connected to a lower end of the first filtering portion 610, and a lower end obliquely extending towards the indoor fan wheel 6. Specifically, the second filtering portion 612 is located below the first filtering portion 610. The second filtering portion 612 can be inclined at an angle identical to or different from the inclination angle of the second heat exchange portion 570, such that the filter screen 600 is in a shape that is the same as or similar to that of the indoor heat exchanger 500, which reduces eddies, lowers noise, and ensures uniformity of the wind output.

As shown in FIG. 4, in some embodiments of the present disclosure, a distance between the first filtering portion 610 and the first heat exchange portion 560 is d1, a distance between the second filtering portion 612 and the second heat exchange portion 570 is d2, and a ratio of d1/d2 is from 0.9 to 1.2. Therefore, the uniformity of the wind output can be ensured, and the filter screen 600 is easy to mount because the ratio of the distances satisfies a certain relationship. Since the distance between the filter screen 600 and the indoor heat exchanger 500 is comparatively uniform, eddies can be further reduced, which facilitates noise reduction.

In some embodiments of the present disclosure, the casing 2 is provided with a sliding slot therein, and the filter screen 600 cooperates with the sliding slot in a push-pull manner, such that the filter screen 600 can be conveniently detached for cleaning, and the filter screen 600 is also easy to mount.

As shown in FIG. 1, in some embodiments of the present disclosure, the indoor portion 11 is provided with the air outlet 14 at a top thereof. A plane where the air outlet 14 is located is an air outlet plane, and the air outlet plane obliquely extends rearwards in a direction from bottom to top. That is, as shown in FIG. 1, in a direction from the inside to the outside, the air outlet plane obliquely extends upwards such that the air outlet 14 is arranged obliquely. As such, the wind output through the air outlet 14 can be blown upwards instead of being directly blown to a user, a refrigeration speed can be increased, and a wind output area of the air outlet 14 can be enlarged, thereby reducing a length of an air channel in an upper part of the indoor portion 11 and avoiding loss in refrigeration capacity.

Optionally, as shown in FIG. 1, an angle B between the air outlet plane and a vertical plane is in a range between 50° and 66°, which can avoid influence on a wind output effect resulting from angle B being too large or too small, and prevents the wind from being directly blown to the user. Meanwhile, the wind output area of the air outlet 14 can be enlarged, the length of the air channel in the upper part of the indoor portion 11 can be shortened, and the loss in refrigeration capacity can be avoided. Preferably, the angle B is in a range between 55° and 62°.

In some embodiments of the present disclosure, the second heat exchange portion 570 has more rows of heat exchange tubes than the first heat exchange portion 560, which can effectively utilize an internal space in the indoor portion 11, and improves a heat exchange effect of the second heat exchange portion 570 and a refrigeration effect of the window air conditioner 1. In some examples of the present disclosure, as shown in FIG. 3 and FIG. 4, the second heat exchange portion 570 has three rows of heat exchange tubes, and the first heat exchange portion 560 has two rows of heat exchange tubes. Certainly, it should be understood that, the number of rows of heat exchange tubes of the second heat exchange portion 570 and the number of rows of heat exchange tubes of the first heat exchange portion 560 can be set according to actual needs, and for instance, the numbers can be the same.

Figure 5:
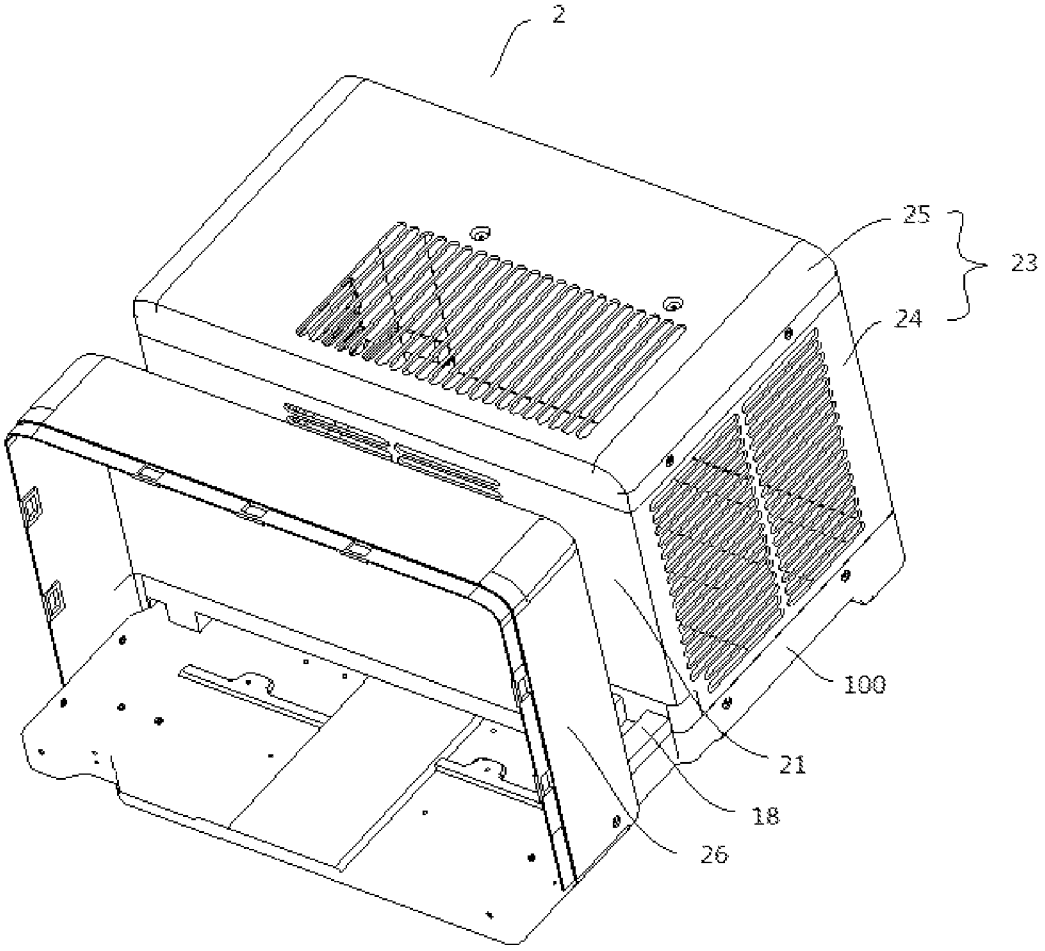
FIG. 5 is a partial view of a window air conditioner according to an embodiment of the present disclosure.

As shown in FIG. 5, in some embodiments of the present disclosure, the casing 2 includes a chassis 100, a rear case 23, and a front case 26. The rear case 23 is fixed on the chassis 100. The rear case 23 receives an outer heat exchanger. The front case 26 is fixed on the chassis 100, and the front case 26 and the rear case 23 are spaced apart in a front-rear direction to define the receiving groove 21. The indoor portion 11 includes the front case 26 and a part of the chassis 100. The outdoor portion 12 includes the rear case 23 and another part of the chassis 100. Thus, the formation of the receiving groove 2121 and hence the cooperation of the window air conditioner 10 and the window 3 are facilitated, the casing 2 is convenient to process and manufacture, and the appearance aesthetics of the casing 2 is improved.

More specifically, as shown in FIG. 5, the casing 2 further includes an intermediate partition board 18 fixed on the chassis 100 and located in the receiving groove 21, and a front end and a rear end of the intermediate partition board 18 cooperate with the rear case 23 and the front case 26, respectively. In such a way, a lower surface of the window 3 can abut against the intermediate partition board 18, which facilitates the wiring and drainage of the window air conditioner 1 and enhances the operational reliability of the window air conditioner 1.

Optionally, as shown in FIG. 5, the rear case 23 includes a rear case seat 24 and a rear case cover 25. The rear case seat 24 has an open top and is fixed on the chassis 100, and the rear case cover 25 covers the top of the rear case seat 24. Thus, the structural flexibility of the rear case 23 is improved, thereby facilitating the disassembly and installation of components in the rear case 23.

Furthermore, the front case 26 is a sheet metal piece or a plastic piece, the rear case 23 is a sheet metal piece, and the intermediate partition board 18 is a plastic piece.

As shown in FIG. 6 to FIG. 18, the window air conditioner 1 according to embodiments of the present disclosure includes a water receiving pan 400 and the indoor heat exchanger 500.

Specifically, the indoor heat exchanger 500 has a side plate assembly, and the water receiving pan 400 is provided with a rib assembly to support the side plate assembly. The water receiving pan 400 is arranged below the indoor heat exchanger 500. It needs to be noted that, in the window air conditioner 1 according to embodiments of the present disclosure, the indoor heat exchanger 500 is provided with the side plate assembly, so as to be connected and assembled with the water receiving pan 400, and the water receiving pan 400 is prevented from directly contacting a heat exchange body of the indoor heat exchanger 500, such that fins of the indoor heat exchanger 500 can be prevented from being pressed by the water receiving pan 400, the structural integrity of the fines can be enhanced, and the heat exchange effect of the indoor heat exchanger 500 can be improved.

Figure 12:
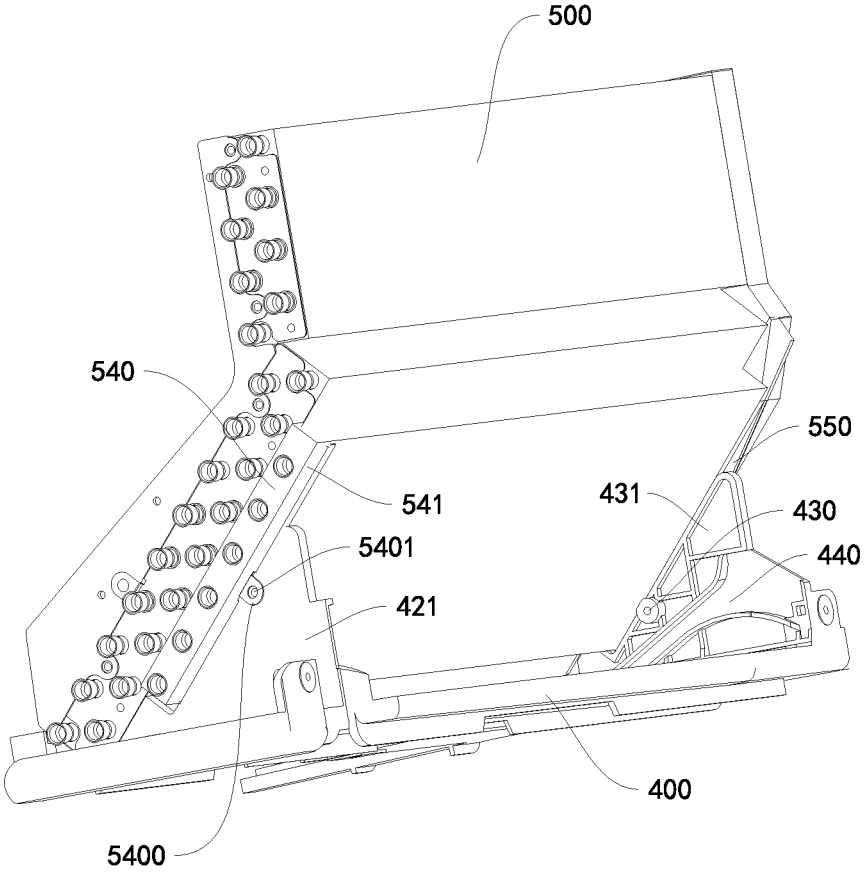
FIG. 12 is a schematic view of a partial structure of a window air conditioner according to an embodiment of the present disclosure.
Figure 13:
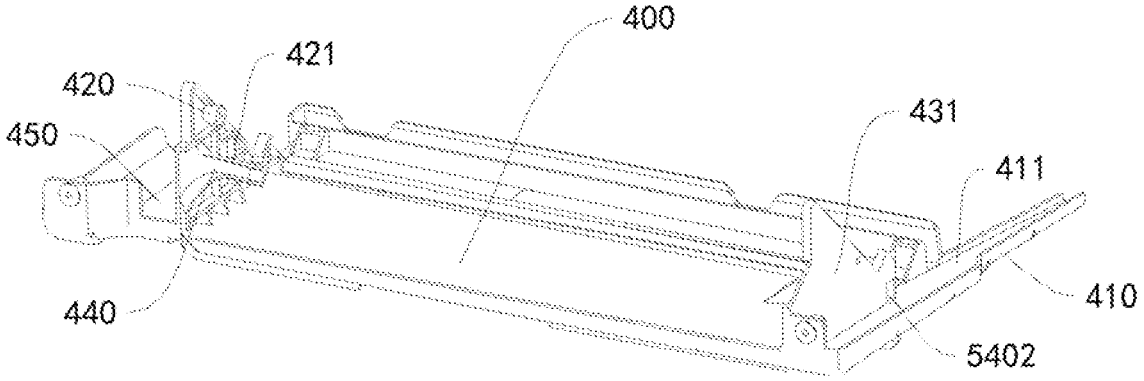
FIG. 13 is a schematic view of a water receiving pan of a window air conditioner according to an embodiment of the present disclosure.

As shown in FIG. 12 and FIG. 13, according to some embodiments of the present disclosure, the rib assembly can include a first rib 421 and a second rib 431 spaced apart from each other. Specifically, the side plate assembly can include a first side plate 540 and a second side plate 550. The first side plate 540 is arranged at a first end of the indoor heat exchanger 500, and the heat exchange tubes of the indoor heat exchanger 500 run through the first side plate 540. The first rib 421 is used to support the first side plate 540, and the second rib 431 is used to support the second side plate 550. The first rib 421 and the second rib 431 can be used to space the indoor heat exchanger 500 apart from the water receiving pan 400, thereby providing an operation space for assembling the indoor heat exchanger 500. In addition, after the indoor heat exchanger 500 and the water receiving pan 400 are assembled, the assembling stability of the indoor heat exchanger 500 and the water receiving pan 400 can be improved.

Furthermore, as shown in FIG. 12 and FIG. 13, the first side plate 540 has a first flange 541, the first flange 541 abuts against the first rib 421, and the first flange 541 is connected to the first rib 421 by means of a screw. Thus, the assembling stability of the indoor heat exchanger 500 and the water receiving pan 400 can be improved. Similarly, the second side plate 550 has a second flange, the second flange abuts against the second rib 431, and the second flange is connected to the second rib 431 by means of a screw. Thus, the assembling stability of the indoor heat exchanger 500 and the water receiving pan 400 can be further improved. In some embodiments, in order to further improve the assembling stability of the indoor heat exchanger 500 and the water receiving pan 400, both the first flange 541 and the second flange are bent towards a center of an indoor side of the window air conditioner 1.

In some embodiments, the first flange 541 extends towards the second side plate 550, and the second flange extends towards the first side plate 540. Thus, deformation of the first flange 541 or the second flange due to a high temperature during welding can be prevented when the indoor heat exchanger 500 is welded, thereby improving the structural stability of the side plate assembly.

As shown in FIG. 12, for easy connection between the indoor heat exchanger 500 and the water receiving pan 400, in some embodiments, one of the first flange 541 and the second flange is provided with a lug 5400, and the lug 5400 defines a screw hole 5401. That is, the first flange 541 and the first rib 421 can be fixedly connected by means of a screw, and the second flange and the second rib 431 can be connected by means of a screw. In some embodiments, in order to improve the stability of the first rib 421 or the second rib 431, at least one of the first rib 421 or the second rib 431 is triangular.

Figure 14:
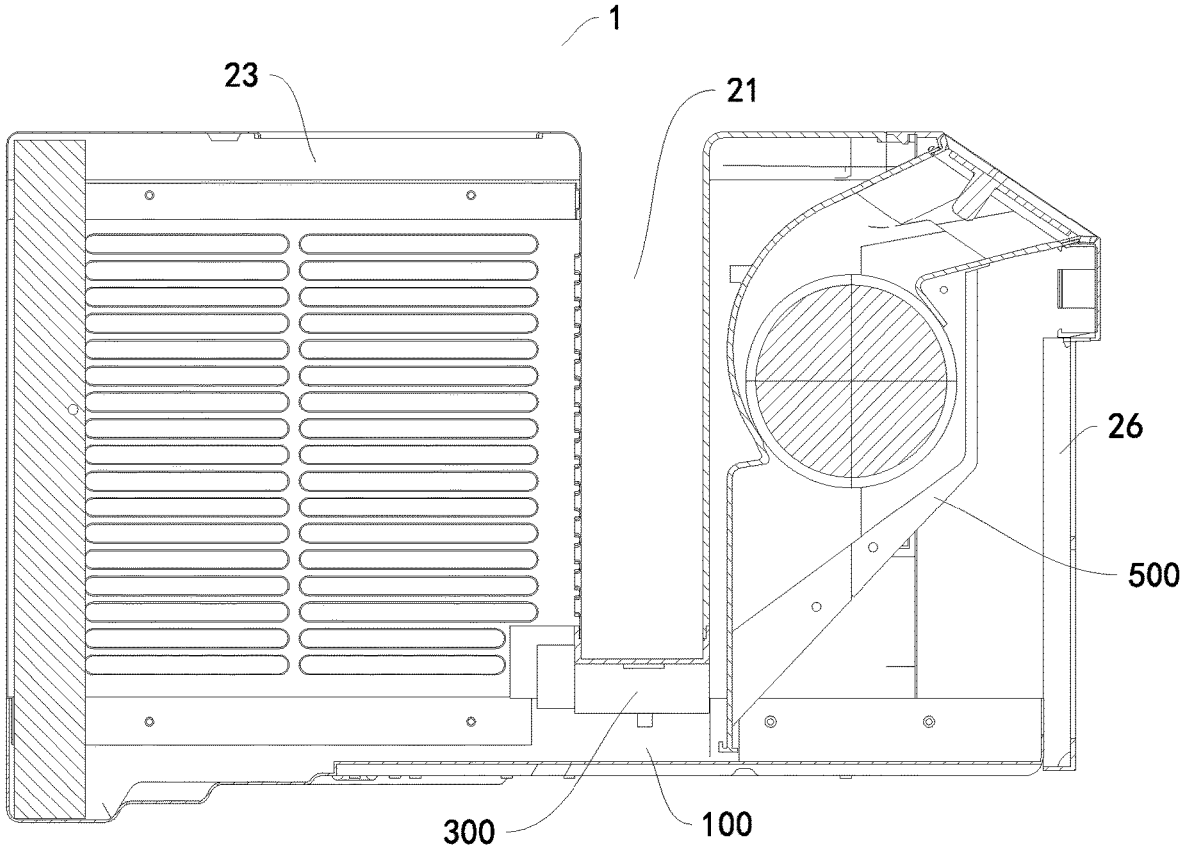
FIG. 14 is a sectional view of a window air conditioner according to an embodiment of the present disclosure.

As shown in FIG. 12, in some embodiments, both the first rib 421 and the second rib 431 have an oblique support surface for supporting the indoor heat exchanger. As shown in FIG. 14, the indoor heat exchanger 500 can include a first heat exchange portion 560 and a second heat exchange portion 570; the first heat exchange portion 560 extends vertically; the second heat exchange portion 570 has an upper end connected to a lower end of the first heat exchange portion 560, and a lower end obliquely extending the outdoor portion. The oblique support surface is used to support a surface of a part of the second heat exchange portion 560 facing the water receiving pan 400.

Figure 8:
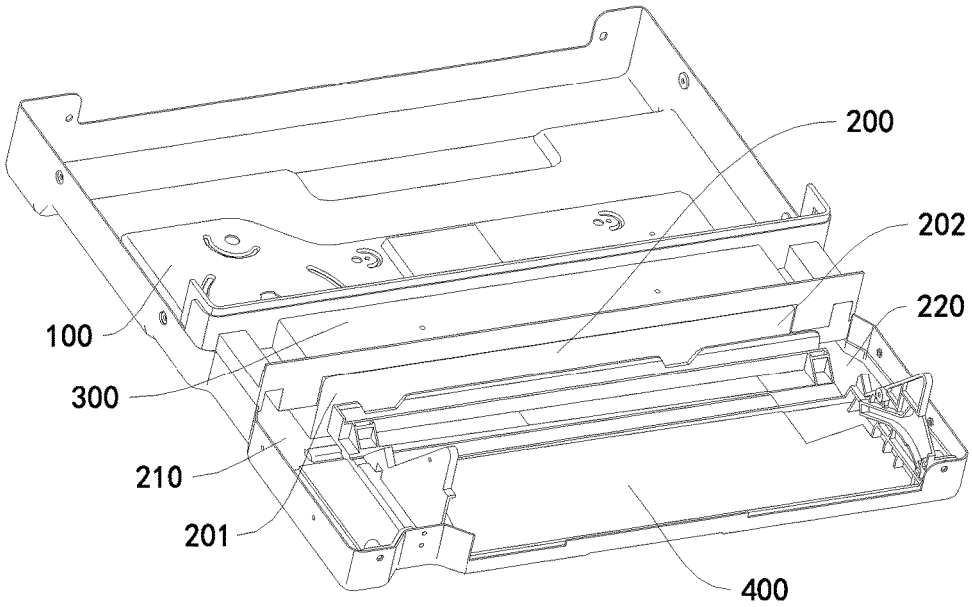
FIG. 8 is a schematic view of a partial structure of a window air conditioner according to an embodiment of the present disclosure.
Figure 9:
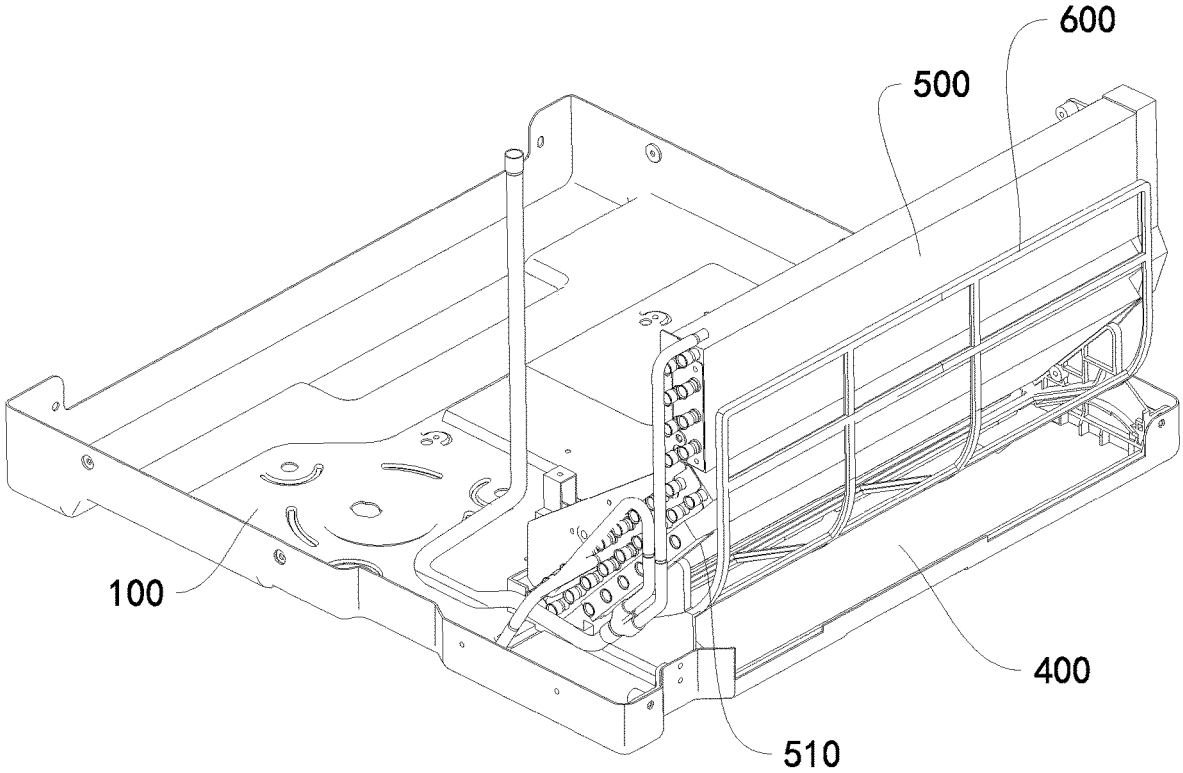
FIG. 9 is a schematic view of a partial structure of a window air conditioner according to an embodiment of the present disclosure.

In order to improve drainage performance of the water receiving pan 400, in some embodiments, as shown in FIG. 8 and FIG. 13, at least one of the first rib 421 or the second rib 431 has a water hole 5402. It is to be noted that, condensation water can flow to a drainage structure (such as a communication member 410 and a drain channel 450) of the water receiving pan 400 through the water hole 5402. As shown in FIG. 13, in some embodiments, the water receiving pan 400 can be provided with an auxiliary water receiving portion 450 for receiving condensation water from a refrigerant tube, and the auxiliary water receiving portion 450 is in communication with the water hole 5402, such that the condensation water can be drained smoothly. In some embodiments, the water receiving pan 400 can be provided with the communication member 410, the communication member 410 defines the drain channel 411 therein, and the water hole 5402 can be in communication with the drain channel 411.

The window air conditioner 1 according to embodiments of the present disclosure will be described with reference to the drawings.

As shown in FIG. 6 to FIG. 18, the window air conditioner 1 according to embodiments of the present disclosure includes the water receiving pan 400 and the indoor heat exchanger 500.

The water receiving pan 400 is provided with a first mounting portion 420 and a second mounting portion 430 spaced apart from each other. The indoor heat exchanger 500 is provided with a third mounting portion 510 and a fourth mounting portion 520. The first mounting portion 420 is connected to the third mounting portion 510, and the second mounting portion 430 is connected to the fourth mounting portion 520.

In the window air conditioner 1 according to embodiments of the present disclosure, with the first mounting portion 420, the second mounting portion 430, the third mounting portion 510 and the fourth mounting portion 520, the water receiving pan 400 can be conveniently connected to the indoor heat exchanger 500, which improves the efficiency of mounting and dismounting the water receiving pan 400 and the indoor heat exchanger 500, and can also ensure reliability and stability of connection between the water receiving pan 400 and the indoor heat exchanger 500, thereby further improving the structural strength, stability and operation performance of the window air conditioner 1.

In addition, since the water receiving pan 400 and the indoor heat exchanger 500 are connected by means of the first mounting portion 420 and the third mounting portion 510 and by means of the second mounting portion 430 and the fourth mounting portion 520, stress between the water receiving pan 400 and the indoor heat exchanger 500 is relatively uniform, which avoids excessive local stress at the connection between the water receiving pan 400 and the indoor heat exchanger 500 and therefore prevents the water receiving pan 400 and the indoor heat exchanger 500 from being damaged, thereby prolonging the service life of the water receiving pan 400 and the indoor heat exchanger 500. Hence, the structural stability and operation reliability of the window air conditioner 1 is further improved.

Therefore, the window air conditioner 1 according to embodiments of the present disclosure is convenient to assemble and is reliable in structure and has other advantages.

The window air conditioner 1 according to a specific embodiment of the present disclosure is described with reference to the drawings.

In some specific embodiments of the present disclosure, as shown in FIG. 9 to FIG. 18, the window air conditioner 1 according to embodiments of the present disclosure includes the water receiving pan 400 and the indoor heat exchanger 500.

Figure 11A:
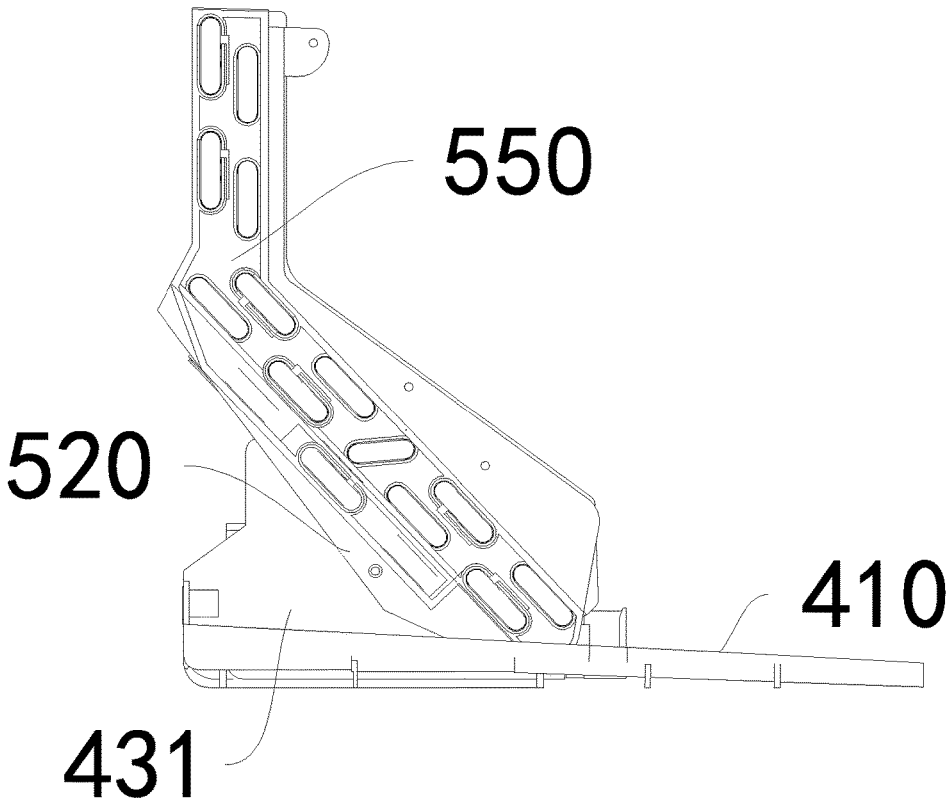
FIG. 11*a* is a schematic view of a partial structure of a window air conditioner according to an embodiment of the present disclosure.
Figure 11B:
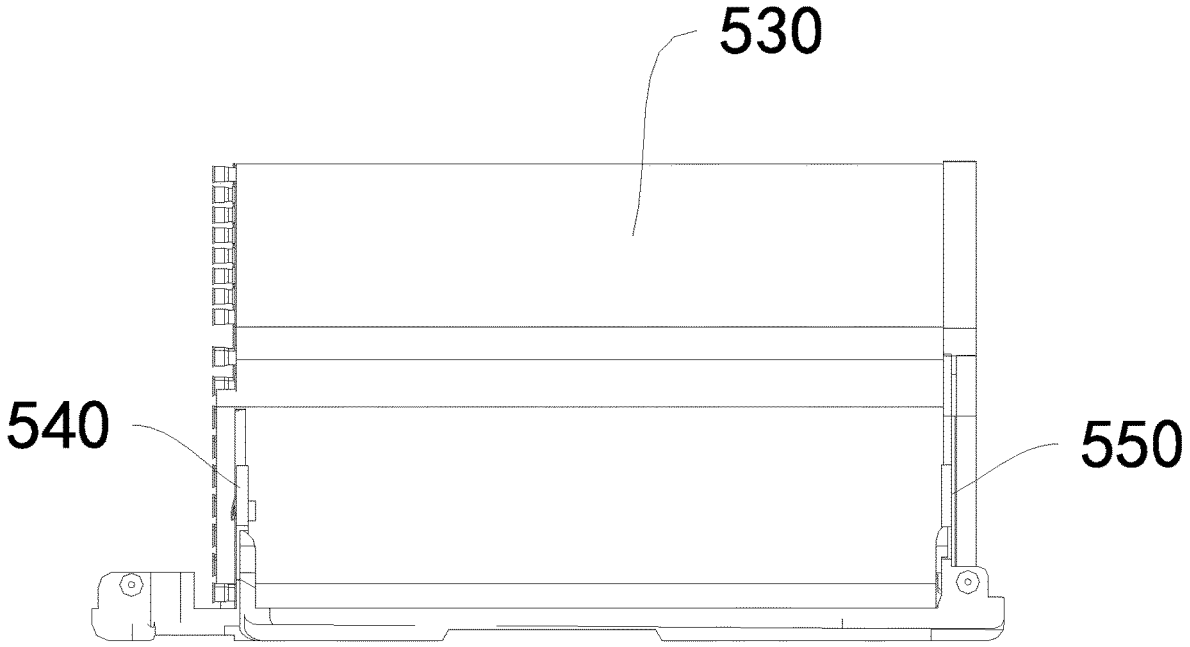
FIG. 11*b* is a schematic view of the partial structure of the window air conditioner according to the embodiment of the present disclosure from another angle of view.

Specifically, as shown in FIG. 11*b*, the indoor heat exchanger 500 includes a heat exchange tube 530, the first side plate 540 and the second side plate 550. The first side plate 540 is arranged at one side of the heat exchange tube 530 and connected to the heat exchange tube 530, and the third mounting portion 510 is arranged at the first side plate 540. The second side plate 550 is arranged at the other side of the heat exchange tube 530 and connected to the heat exchange tube 530, and the fourth mounting portion 520 is arranged at the second side plate 550. In this case, the third mounting portion 510 and the fourth mounting portion 520 can be processed and arranged conveniently, thereby further facilitating the connection between the water receiving pan 400 and the indoor heat exchanger 500.

Figure 11C:
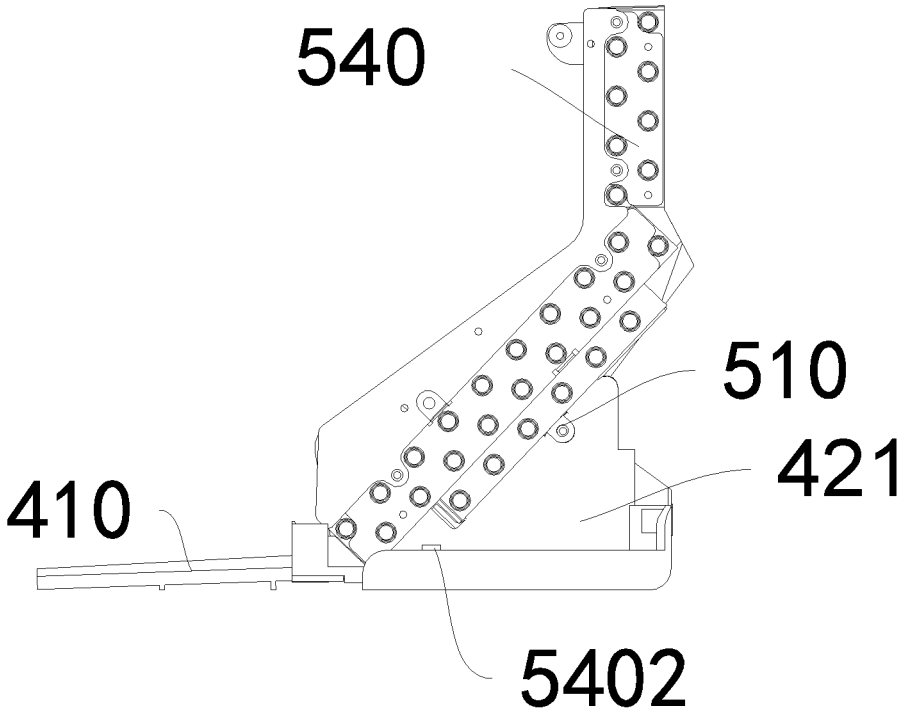
FIG. 11*c* is a schematic view of the partial structure of the window air conditioner according to the embodiment of the present disclosure from still another angle of view.

More specifically, as shown in FIG. 11*c*, the first side plate 540 has the first flange, and the first flange is configured as the third mounting portion 510. The second side plate 550 has the second flange, and the second flange is configured as the fourth mounting portion 520. In this case, it is convenient to machine and form the third mounting portion 510 and the fourth mounting portion 520, and it is conductive to improving the production efficiency and structural strength of the third mounting portion 510 and the fourth mounting portion 520, and further improving the strength of connection between the water receiving pan 400 and the indoor heat exchanger 500.

Optionally, the first side plate 540 is a sheet metal piece, and the second side plate 550 is a plastic piece. In this case, the indoor heat exchanger 500 can be assembled and formed conveniently, the cooperation between the indoor heat exchanger 500 and the water receiving pan 400 can be facilitated, the assembly process of the indoor heat exchanger 500 can be simplified, and the assembly efficiency of the indoor heat exchanger 500 can be improved.

Specifically, the first mounting portion 420 is connected to the third mounting portion 510 by snapping or by means of a screw. The second mounting portion 430 is connected to the fourth mounting portion 520 by snapping or by means of a screw. In this case, the first mounting portion 420 can be fixedly mounted to the third mounting portion 510, and the second mounting portion 430 can be fixedly mounted to the fourth mounting portion 520, thereby ensuring the reliable connection between the water receiving pan 400 and the indoor heat exchanger 500. In the meantime, it is convenient to mount and dismount the water receiving pan 400 and the indoor heat exchanger 500, which improves the production efficiency of the window air conditioner 1 and reduces the maintenance cost of the window air conditioner 1.

Figure 10:
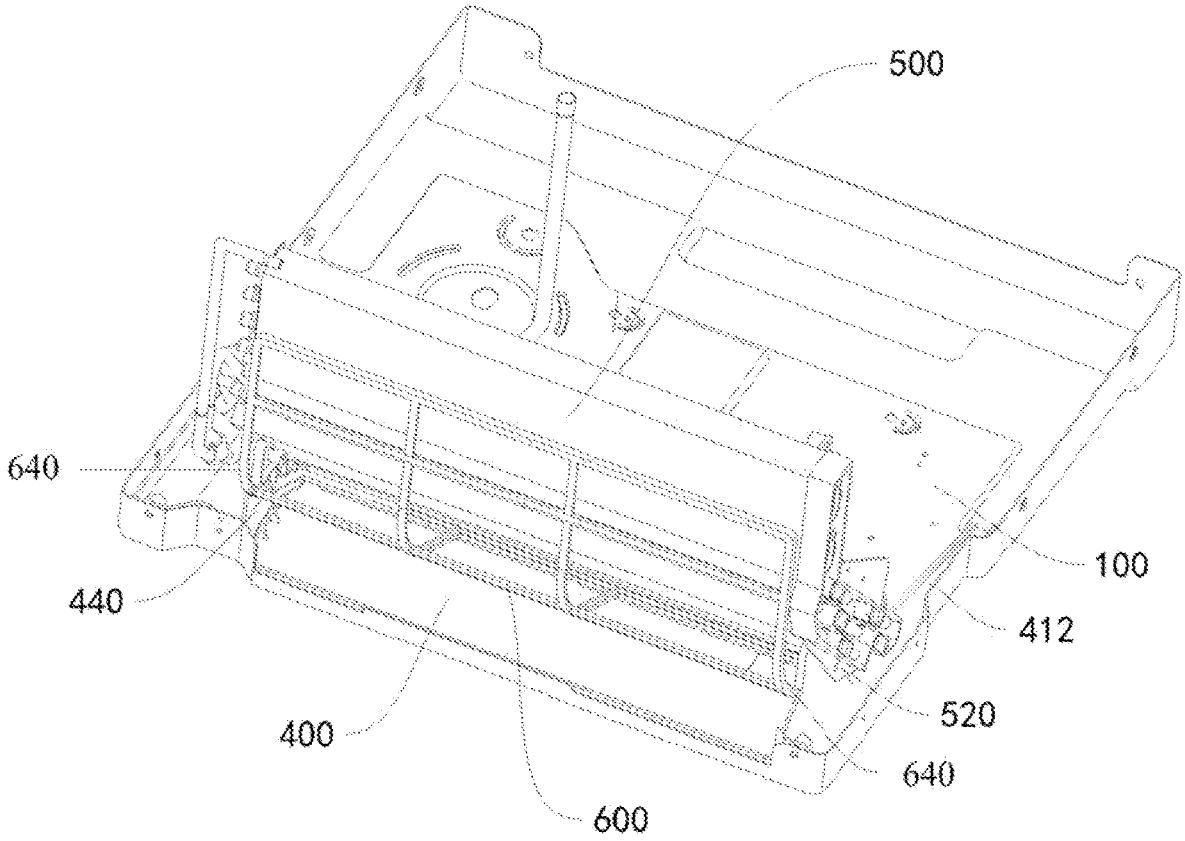
FIG. 10 is a schematic view of a partial structure of a window air conditioner according to an embodiment of the present disclosure.

Optionally, as shown in FIG. 10, and FIGS. 12-13, the water receiving pan 400 is provided with a first fitting portion 440, the window air conditioner 1 further includes the filter screen 600, and the filter screen 600 has a second fitting portion 640 cooperating with the first fitting portion 440. In this case, it is convenient to install and arrange the filter screen 600, and the cooperation between the filter screen 600 and the water receiving pan 400 can be facilitated, thereby improving the assembly efficiency of the filter screen 600.

Furthermore, one of the first fitting portion 440 and the second fitting portion 640 includes a slot, and the other one thereof is received in the slot. The first fitting portion 440 and the second fitting portion 640 can be used for positioning and guiding the filter screen 600 during installation, thereby improving the accuracy and reliability of installation of the filter screen 600, and facilitating the installation of the filter screen 600 to the water receiving pan 400.

Specifically, as shown in FIG. 13, the water receiving pan 400 is provided with the communication member 410, and the communication member 410 has the drain channel 411 therein. In this case, the communication member 410 can be used to drain condensation water in the water receiving pan 400, thereby avoiding too much condensation water from being accumulated in the water receiving pan 400, and hence improving operation reliability of the water receiving pan 400.

More specifically, the communication member 410 is connected to the second mounting portion 430. Hence, it is convenient to mount and arrange the communication member 410, and the drainage performance of the communication member 410 is improved.

Furthermore, as shown in FIG. 13, at least a part of the drain channel 411 is configured as a tapered segment 412, and the tapered segment 412 has a gradually reduced cross sectional area. More specifically, in a direction from an indoor side to an outdoor side, the cross sectional area of the tapered segment 412 is gradually decreased. In this case, the drainage capacity of the drain channel 411 is improved, the condensation water in the water receiving pan 400 can be smoothly drained, and the drainage effect of the water receiving pan 400 can be improved.

Optionally, the drain channel 411 has an inclined inner bottom wall, which facilitates the flowing of the condensation water in the drain channel 411, thereby improving the drainage effect of the drain channel 411.

Furthermore, in the direction from the indoor side to the outdoor side, the inner bottom wall of the drain channel 411 gradually inclines towards the outdoor side. In this case, the condensation water in the water receiving pan 400 can be easily and smoothly drained by gravity, thereby improving drainage efficiency of the water receiving pan 400.

Specifically, the water receiving pan 400 includes the first rib and the second rib. The first rib is arranged at one side of the water receiving pan 400, and the first rib is configured as the first mounting portion 420. The second rib is arranged at the other side of the water receiving pan 400, and the second rib is configured as the second mounting portion 430. In this case, the first mounting portion 420 and the second mounting portion 430 can be machined and arranged conveniently, and the cooperation between the first mounting portion 420 and the third mounting portion 510 and the cooperation between the second mounting portion 430 and the fourth mounting portion 520 can be facilitated, thereby facilitating connection between the water receiving pan 400 and the indoor heat exchanger 500.

Optionally, the window air conditioner 1 further includes the chassis 100, an intermediate partition plate 300, the outdoor portion, and the indoor portion. The intermediate partition plate 300 is connected to the chassis 100, and the water receiving pan 400 is arranged in the indoor portion. The indoor portion, the intermediate partition plate 300, and the outdoor portion define the receiving groove 21 for receiving the window. The indoor heat exchanger 500 is arranged in the indoor portion, and the water receiving pan 400 is arranged below the indoor heat exchanger 500 (an up-down direction as indicated by arrow A in FIG. 1). In this case, the installation and arrangement of the window air conditioner 1 can be facilitated, the structural stability of the window air conditioner 1 can be improved, and the installation part of the window air conditioner 1 can be sealed conveniently, thereby improving the performance of sealing between the indoor side and the outdoor side after the window air conditioner 1 is installed. Moreover, the window air conditioner 1 can have a neat and artistic appearance.

Figure 6:
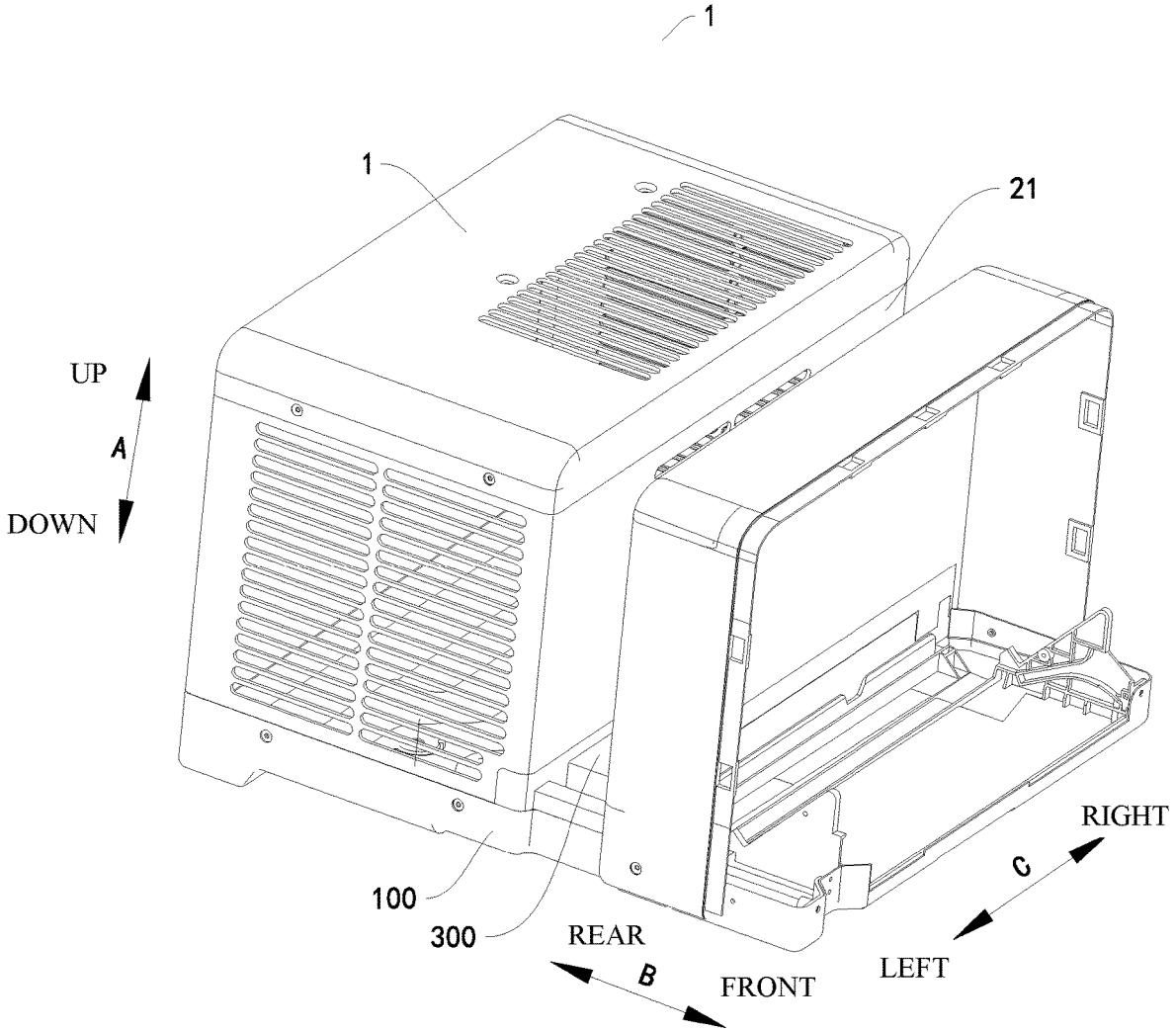
FIG. 6 is a schematic view of a window air conditioner according to an embodiment of the present disclosure.
Figure 7:
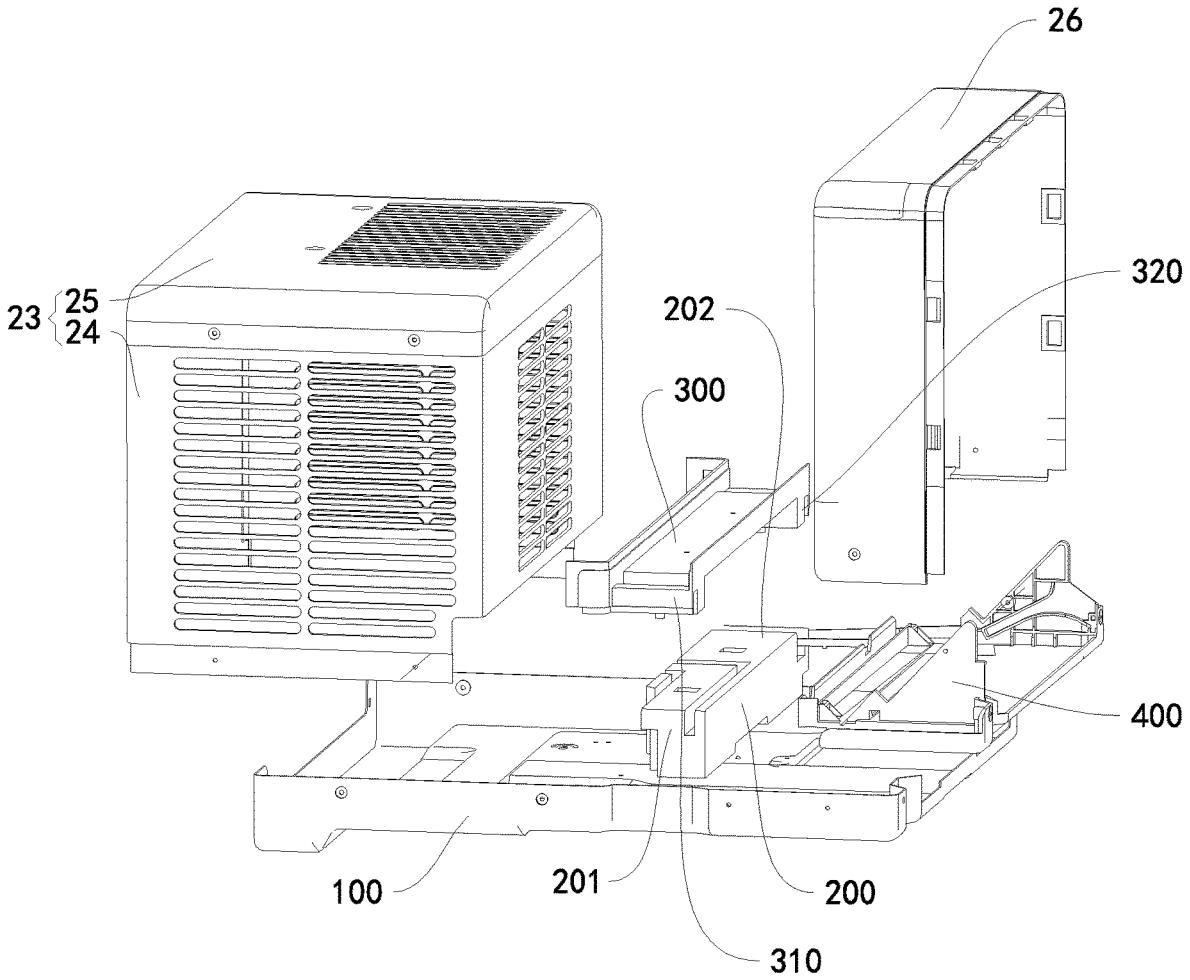
FIG. 7 is an exploded view of a window air conditioner according to an embodiment of the present disclosure.

In some embodiments of the present disclosure, as shown in FIG. 6 and FIG. 7, the window air conditioner 1 is supported by the window opening 5 in the wall 4, and the window opening is provided with the movable window therein. The window air conditioner 1 includes the casing 2, the casing 2 has the outer peripheral wall provided with the receiving groove 21, and the receiving groove 21 is opened at the top, the left side, and the right side thereof (a left-right direction as indicated by arrow C in FIG. 1). The casing 2 is divided into the indoor portion and the outdoor portion through the receiving groove 21. At least a part of the window 4 can extend into the receiving groove 21. The indoor portion is provided with an indoor heat exchanger (such as the indoor heat exchanger 500) and an indoor fan, while the outdoor portion is provided with an outdoor heat exchanger and an outdoor fan.

Optionally, as shown in FIG. 6 and FIG. 7, the casing 2 includes the chassis 100, the rear case 23, and the front case 26 (a front-rear direction indicated by arrow B in FIG. 1). The rear case 23 is fixed to the rear case 23 and the front case 26. The front case 26 is fixed to the rear case 23 and the front case 26. The front case 26 and the rear case 23 are spaced apart in the front-rear direction to define the receiving groove 21. The rear case 23 and the front case 26, the rear case 23, and the front case 26 are independently machined parts, which not only facilitates the formation of the receiving groove 21 and hence the cooperation between the window air conditioner 1 and the window, but also facilitates the processing of the rear case 23 and the front case 26, the rear case 23, and the front case 26 to allow the rear case 23 and the front case 26, the rear case 23, and the front case 26 to be processed by using different materials. For example, the rear case 23 is a sheet metal piece, and the front case 26 is a plastic piece, which improves the structural performance and the appearance aesthetics of the casing 2.

Specifically, as shown in FIG. 6 and FIG. 7, the intermediate partition plate 300 is fixed on the chassis 100 and located in the receiving groove 21, and a front end and a rear end of the intermediate partition plate 300 cooperate with the rear case 23 and the front case 26, respectively. In such a way, a lower surface of the window can abut against the intermediate partition plate 300, which facilitates the wiring and drainage of the window air conditioner 1 and enhances the operational reliability of the window air conditioner 10.

Optionally, as shown in FIG. 6 and FIG. 7, the rear case 23 includes the rear case seat 24 and the rear case cover 25. The rear case seat 24 has an open top and is fixed on the chassis 100, and the rear case cover 25 covers the top of the rear case seat 24. Thus, the structural flexibility of the rear case 23 is improved, thereby facilitating the disassembly and installation of components in the rear case 23.

Further, the front case 24 is a sheet metal piece or a plastic piece, the rear case 23 is a sheet metal piece, and the intermediate partition plate 300 is a plastic piece.

According to some embodiments of the present disclosure, the window air conditioner 1 further includes a soundproof member 200, and the soundproof member 200 is arranged at the chassis 100 to divide the chassis 100 into an indoor side and an outdoor side. The soundproof member 200 is connected to the chassis 100 by means of the intermediate partition plate 300 and is sandwiched between the chassis 100 and the intermediate partition plate 300. In this case, the soundproof member 200 can be used to isolate airflow between the indoor side and the outdoor side, and the installation part of the window air conditioner 1 can be sealed more conveniently. That is, it is convenient to seal a space between the window and a mounting opening, thereby improving the sealing effect at the installation position of the window air conditioner 1, and enhancing the heat insulation and sound insulation between the indoor side and the outdoor side, so as to prevent outdoor temperature and outdoor noise from affecting the indoor environment, improve user experience, and improve the functionality and applicability of the window air conditioner 1.

Furthermore, since the soundproof member 200 is sandwiched between the chassis 100 and the intermediate partition plate 300, it is convenient to position, install and arrange the soundproof member 200, thereby improving the arrangement reliability and accuracy of the soundproof member 200, improving the sealing effect and sound insulation effect of the soundproof member 200, and improving the use comfort.

Specifically, as shown in FIG. 7, the soundproof member 200 is rectangular, and the soundproof member 200 has two opposite ends, namely, a first end 201 and a second end 202. The first end 201 and one side edge of the chassis 100 define a first channel 210, and the second end 202 and the other side edge of the chassis 100 define a second channel 220. In this case, the first channel 210 and the second channel 220 can form spaces connecting two sides of the soundproof member 200, which facilitates pipe connection and drainage between the indoor side and the outdoor side of the window air conditioner 1. For instance, a pipe can pass through the first channel 210, and the second channel 220 provides a path for drainage, which facilitates arrangement of internal structures of the window air conditioner 1. The window air conditioner 1 has a reasonable and compact structure, and improved operation performance.

Furthermore, the pipe runs through the first channel 210, and the second channel 220 provides the path for drainage, such that the window air conditioner 1 has its pipe channel and its drain channel located at two sides of the window air conditioner 1 respectively, which prevents the pipe channel and the drain channel from affecting each other, and improves operation reliability and stability of the window air conditioner 1.

More specifically, as shown in FIG. 7, the intermediate partition plate 300 has a first extension 310 at a first end and a second extension 320 at a second end. The first extension 310 has at least a portion abutting against an inner wall of the first channel 210 to cooperatively define the first channel 210. The second extension 320 has at least a portion abutting against an inner wall of the second channel 220 to cooperatively define the second channel 220. At least one of the first extension 310 or the second extension 320 is connected to the chassis 100. In this case, it is not only convenient for installing and arranging the soundproof member 200 and for connecting the intermediate partition plate 300 with the chassis 100, but also convenient for forming the first channel 210 and the second channel 220.

Specifically, the first channel 210 is provided with a sponge member or an enclosure member. In this case, the sponge member or the enclosure member can be used to fill gaps in the first channel 210 after installation of the pipes, thereby further improving the sealing effect in the installation position of the window air conditioner 1.

Optionally, the soundproof member 200 is a foam member. In this case, it is convenient to machine and produce the soundproof member 200, to increase the production efficiency of the soundproof member 200, and to improve a sealing effect of the soundproof member 200, such that the soundproof member 200 can be used for noise isolation.

Certainly, the soundproof member 200 may be a member made of rubber, silicone, sponge, or the like.

Specifically, the intermediate partition plate 300 is connected to the chassis 100 by a screw, which improves reliability and strength of connection between the intermediate partition plate 300 and the chassis 100.

According to a specific embodiment of the present disclosure, as shown in FIG. 7, the water receiving pan 400 is located at the indoor side, the water receiving pan 400 is connected to the chassis 100, the water receiving pan 400 is provided with the communication member 410, the communication member 410 runs in the second channel 220, the communication member 410 has the drain channel 411 therein, and the outdoor side is in communication with the water receiving pan 400 by means of the drain channel 411. In this case, it is convenient to drain the condensation water in the water receiving pan 400 to the outdoor side, and drain the condensation water in the water receiving pan 400 smoothly, thereby improving drainage performance of the water receiving pan 400.

Figure 15:
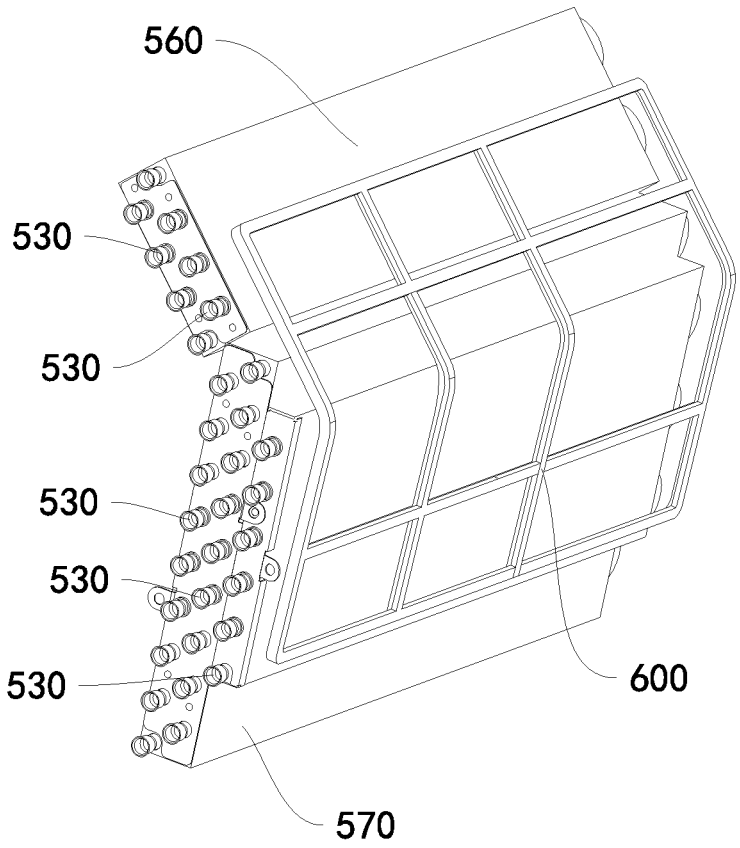
FIG. 15 is a schematic view of a heat exchanger assembly and a filter screen of a window air conditioner according to an embodiment of the present disclosure.
Figure 16:
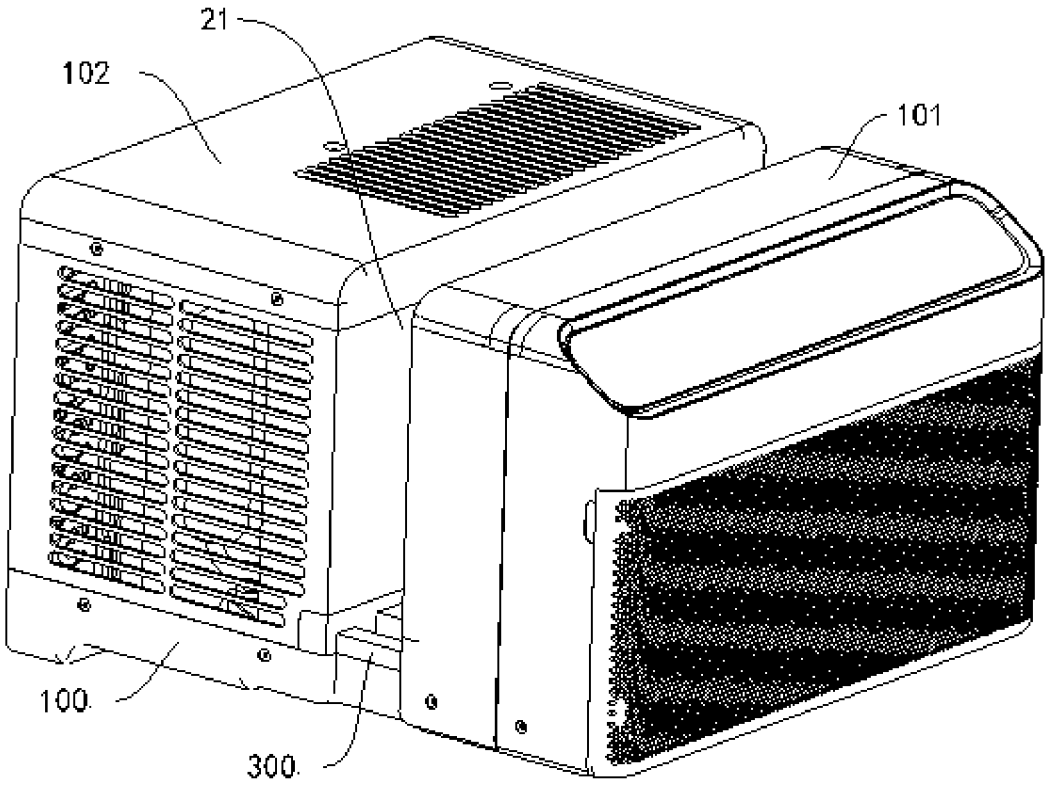
FIG. 16 is a perspective view of a window air conditioner according to an embodiment of the present disclosure.
Figure 17:
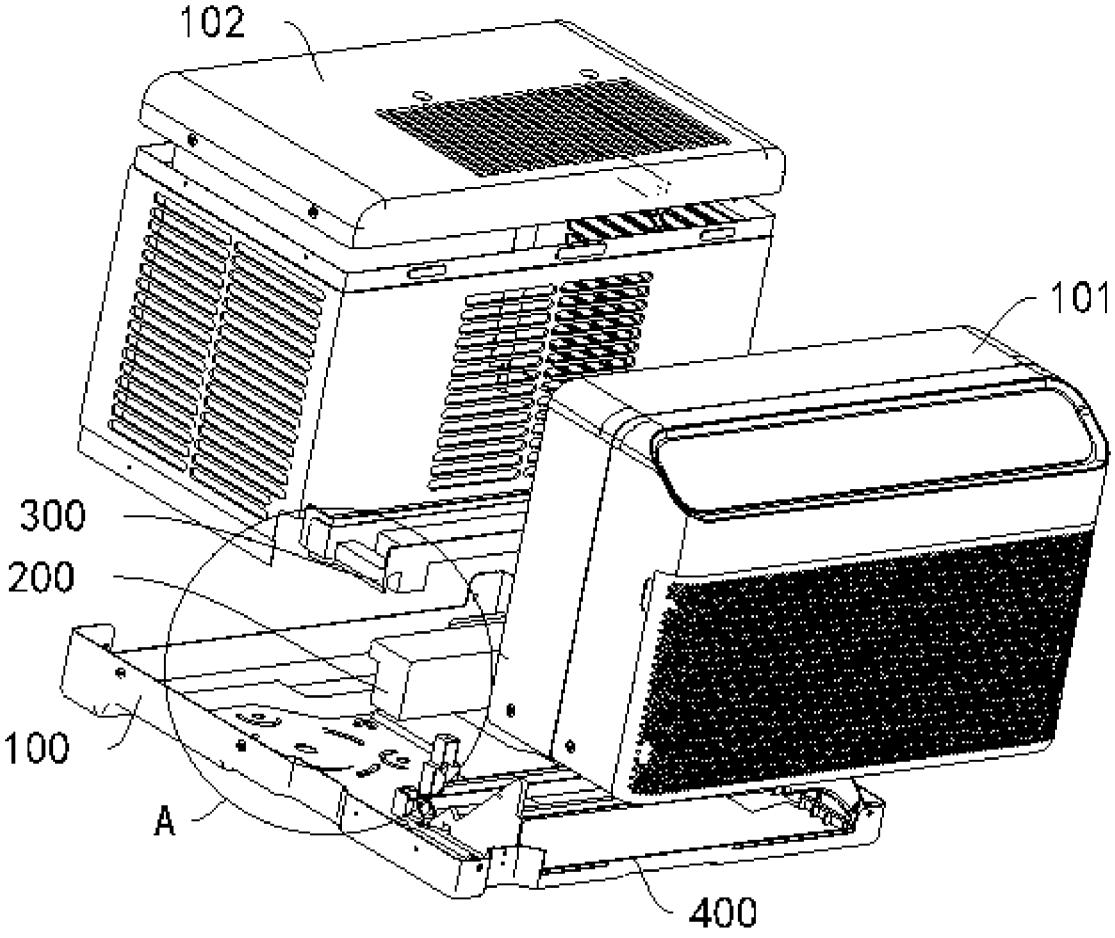
FIG. 17 is an exploded view of a window air conditioner according to an embodiment of the present disclosure.
Figure 18:
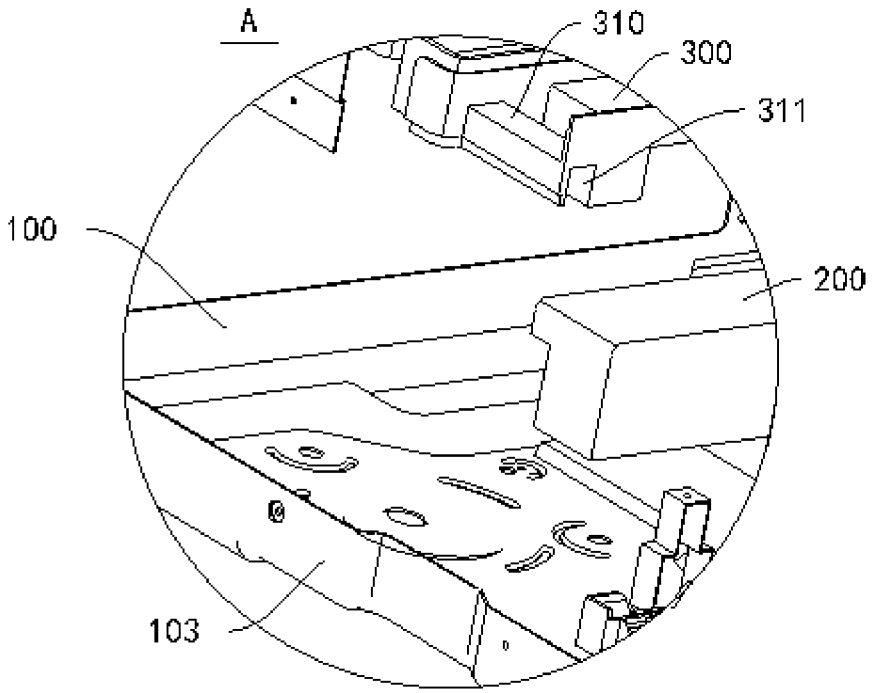
FIG. 18 is a partially enlarged view of part A in FIG. 17.

Specifically, as shown in FIG. 15, the indoor heat exchanger 500 includes the first heat exchange portion 560 and the second heat exchange portion 570. The first heat exchange portion 560 extends vertically. The second heat exchange portion 570 has an upper end connected to the lower end of the first heat exchange portion 560, and a lower end obliquely extending towards the outdoor side. The indoor heat exchanger 500 includes the first heat exchange portion 560 extending vertically and the second heat exchange portion 570 extending obliquely, which not only increases the heat exchange area and improves the heat exchange effect of the indoor heat exchanger 500, but also reduces the space occupied by the indoor heat exchanger 500, thereby reducing the volume of the window air conditioner 1 and the space occupied by the window air conditioner 1.

In some embodiments of the present disclosure, the angle A between the second heat exchange portion 570 and the horizontal plane is in the range between 35° and 55°, such that it is possible to avoid influencing the heat exchange effect and occupying more space resulting from the inclination angle of the second heat exchange portion 570 being too large or too small. Preferably, the angle A between the second heat exchange portion 570 and the horizontal plane is 45°

In some embodiments of the present disclosure, the first heat exchange portion 560 vertically extends by the length H1, the second heat exchange portion 570 obliquely extends by the length H2, and the ratio of H1/H2 is in the range between 0.2 and 0.4. Thus, a space in a lower portion of the indoor side can be utilized reasonably. Preferably, the ratio of H1/H2 is 0.3.

More specifically, the second heat exchange portion 570 has more rows of heat exchange tubes 530 than the first heat exchange portion 560, which can effectively utilize the internal space of the indoor portion 11, and improves the heat exchange effect of the second heat exchange portion 570 and the refrigeration effect of the window air conditioner 1.

Optionally, as shown in FIG. 15, the second heat exchange portion 570 has three rows of heat exchange tubes 530, and the first heat exchange portion 560 has two rows of heat exchange tubes 530. Certainly, it should be understood that, the number of rows of heat exchange tubes of the second heat exchange portion 570 and the number of rows of heat exchange tubes of the first heat exchange portion 560 can be set according to actual needs, and for instance, the numbers can be the same.

Other configurations and operations of the window air conditioner 1 according to embodiments of the present disclosure are known to those skilled in the art and will not described herein.

Reference throughout this specification to "an embodiment," "some embodiments," "an exemplary embodiment," "an example," "a specific example," or "some examples," means that a particular feature, structure, material, or characteristic described in connection with the embodiment or example is included in at least one embodiment or example of the present disclosure. Thus, the illustrative descriptions in connection with the above terms throughout this specification are not necessarily referring to the same embodiment or example of the present disclosure. Furthermore, the particular features, structures, materials, or characteristics may be combined in any suitable manner in one or more embodiments or examples.

Although embodiments of the present disclosure have been shown and described, it would be appreciated by those skilled in the art that changes, modifications, alternatives and variations can be made in the embodiments without departing from the scope of the present disclosure. The scope of the invention is defined by the claims and the like.

What is claimed is:

1. A window air conditioner comprising:

a casing including an indoor portion and an outdoor portion, the indoor portion including an air inlet and an air outlet;

an indoor fan wheel arranged in the indoor portion;

an indoor heat exchanger arranged in the indoor portion and including:

a side plate assembly;

a first heat exchange portion extending vertically; and a second heat exchange portion connected to the first heat exchange portion and extending obliquely towards the indoor fan wheel;

a water receiving pan below the indoor heat exchanger, the water receiving pan including:

a rib assembly configured to support the side plate assembly; and a first fitting portion; and a filter screen located upstream of the indoor heat exchanger in an air flowing direction, the filter screen including a second fitting portion cooperating with the first fitting portion.

2. The window air conditioner according to claim 1, wherein an angle between the second heat exchange portion and a horizontal plane is in a range between 35° and 55°.

3. The window air conditioner according to claim 1, wherein a ratio of a length of the first heat exchange portion to a length of the second heat exchange portion is in a range between 0.2 and 0.4.

4. The window air conditioner according to claim 1, wherein:

the filter screen is spaced apart from the indoor heat exchanger; and the filter screen comprises:

a first filtering portion extending vertically; and a second filtering portion connected to the first filtering portion and extending obliquely towards the indoor fan wheel.

5. The window air conditioner according to claim 4, wherein a ratio of a distance between the first filtering portion and the first heat exchange portion to a distance between the second filtering portion and the second heat exchange portion ranges from 0.9 to 1.2.

6. The window air conditioner according to claim 1, wherein a number of rows of heat exchange tubes in the second heat exchange portion is larger than a number of rows of heat exchange tubes in the first heat exchange portion.

7. The window air conditioner according to claim 1, wherein the air outlet is arranged at a top of the indoor portion, an air outlet plane of the air outlet extending obliquely rearwards in a direction from bottom to top.

8. The window air conditioner according to claim 1, wherein the casing includes a receiving groove formed at an outer peripheral wall of the casing, the receiving groove separating the casing into the indoor portion and the outdoor portion.

9. The window air conditioner according to claim 8, wherein the casing comprises:

a chassis;

a rear case fixed on the chassis and configured to receive an outer heat exchanger; and a front case fixed on the chassis and spaced apart from the rear case in a front-rear direction, the receiving groove being formed between the front case and the rear case.

10. The window air conditioner according to claim 1, wherein one of the first fitting portion and the second fitting portion includes a slot, and another one of the first fitting portion and the second fitting portion is configured to be received in the slot.

11. The window air conditioner according to claim 1, wherein:

the side plate assembly comprises:

a first side plate arranged at a first end of the indoor heat exchanger, a heat exchange tube of the indoor heat exchanger running through the first side plate; and a second side plate arranged at a second end of the indoor heat exchanger; and the rib assembly comprises a first rib and a second rib spaced apart from each other and configured to support the first side plate and the second side plate, respectively.

12. The window air conditioner according to claim 11, wherein:

the first side plate has a first flange abutting against the first rib and connected to the first rib by a first screw; and the second side plate has a second flange abutting against the second rib and connected to the second rib by a second screw.

13. The window air conditioner according to claim 12, wherein the first flange extends towards the second side plate, and the second flange extends towards the first side plate.

14. The window air conditioner according to claim 12, wherein the first flange and the second flange each include a lug having a screw hole.

15. The window air conditioner according to claim 11, wherein the first rib and the second rib each have an oblique support surface to support a surface of a part of the second heat exchange portion facing the water receiving pan.

16. The window air conditioner according to claim 11, wherein the first rib and the second rib each have a water hole.

17. The window air conditioner according to claim 16, wherein the water receiving pan includes an auxiliary water receiving portion configured to receive condensation water from a refrigerant tube, and the auxiliary water receiving portion is in communication with the water hole.

18. The window air conditioner according to claim 17, wherein the first rib is provided with the water hole, and a drain channel is located at a side of the first rib away from the second rib.

* * * * *